US008369761B2

(12) United States Patent
Baba

(10) Patent No.: US 8,369,761 B2
(45) Date of Patent: Feb. 5, 2013

(54) HEATING DEVICE AND IMAGE FORMING APPARATUS HAVING A HEATING MEMBER WITH A HEAT GENERATION LAYER

(75) Inventor: Motofumi Baba, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 12/829,828

(22) Filed: Jul. 2, 2010

(65) Prior Publication Data

US 2011/0135355 A1 Jun. 9, 2011

(30) Foreign Application Priority Data

Dec. 3, 2009 (JP) ..... 2009-275624
Dec. 7, 2009 (JP) ..... 2009-277449

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 7,925,197 | B2 * | 4/2011 | Takagi et al. | 399/329 |
| 2003/0095818 | A1 | 5/2003 | Nakayama | |
| 2004/0253887 | A1 * | 12/2004 | Katakabe et al. | 442/6 |
| 2005/0244199 | A1 | 11/2005 | Nakayama | |
| 2006/0029444 | A1 | 2/2006 | Naito et al. | |
| 2008/0118283 | A1 * | 5/2008 | Tsueda et al. | 399/333 |
| 2008/0131161 | A1 * | 6/2008 | Kikuchi | 399/70 |

FOREIGN PATENT DOCUMENTS

| | | | |
|---|---|---|---|
| JP | 2000267478 A | * | 9/2000 |
| JP | 2003-084591 A | | 3/2003 |
| JP | 2003-091185 A | | 3/2003 |
| JP | 2003-122149 A | | 4/2003 |
| JP | 2003-186322 A | | 7/2003 |
| JP | 2003-223064 A | | 8/2003 |
| JP | 2005-249958 A | | 9/2005 |
| JP | 2006-047768 A | | 2/2006 |

* cited by examiner

*Primary Examiner* — Quana M Grainger
(74) *Attorney, Agent, or Firm* — Sughrue Mion, PLLC

(57) ABSTRACT

A heating device includes: a heating member heating a recording medium by being heated through electromagnetic induction; a pressure member configured to come into contact with and separate from the heating member, and forming a nip portion between the pressure member and the heating member by pressing and coming into contact with the heating member; a first elastic member arranged inside the heating member, and elastically deformed at the nip portion by the pressure member; and any one of a second elastic member and a support member. The second elastic member is arranged between the first elastic member and the heating member while being fixed thereto, and has a larger elastic deformation ratio at the nip portion than the first elastic member. The support member supports the heating member and the first elastic member so as to form a gap therebetween, and rotates them with a rotational drive force.

14 Claims, 16 Drawing Sheets

HEATING DEVICE AND IMAGE FORMING APPARATUS HAVING A HEATING MEMBER WITH A HEAT GENERATION LAYER

CROSS REFERENCE TO RELATED APPLICATIONS

This application is based on and claims priority under 35 USC §119 from Japanese Patent Applications No. 2009-275624 filed Dec. 3, 2009, and No. 2009-277449 filed Dec. 7, 2009.

BACKGROUND

1. Technical Field

The present invention relates to a heating device and an image forming apparatus.

2. Related Art

There is known a heating method using an electromagnetic induction for a heating device (fixing device) to be installed in an image forming apparatus such as a copier and a printer using an electrophotographic method.

SUMMARY

According to an aspect of the present invention, there is provided a heating device including: a heating member that includes a heat generation layer generating heat through electromagnetic induction, and that heats a recording medium by the heat generation layer heated through electromagnetic induction; a pressure member that is configured to come into contact with and to separate from the heating member, and that forms a nip portion between the pressure member and the heating member by coming into contact with the heating member, the nip portion being a portion through which the recording medium passes; a first elastic member that is arranged at an inner side of the heating member, and that is elastically deformed at the nip portion by a pressing force from the pressure member; and any one of a second elastic member and a support member, the second elastic member being arranged between an outer circumferential surface of the first elastic member and an inner circumferential surface of the heating member while being fixed to both of the first elastic member and the heating member, and having a larger elastic deformation ratio at the nip portion than the first elastic member, the support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member.

BRIEF DESCRIPTION OF THE DRAWINGS

Exemplary embodiment(s) of the present invention will be described in detail based on the following figures, wherein.

DETAILED DESCRIPTION

Exemplary embodiments of the present invention will be described below in detail with reference to the accompanying drawings.

[First Exemplary Embodiment]

<Description of Image Forming Apparatus>

Figure 1:
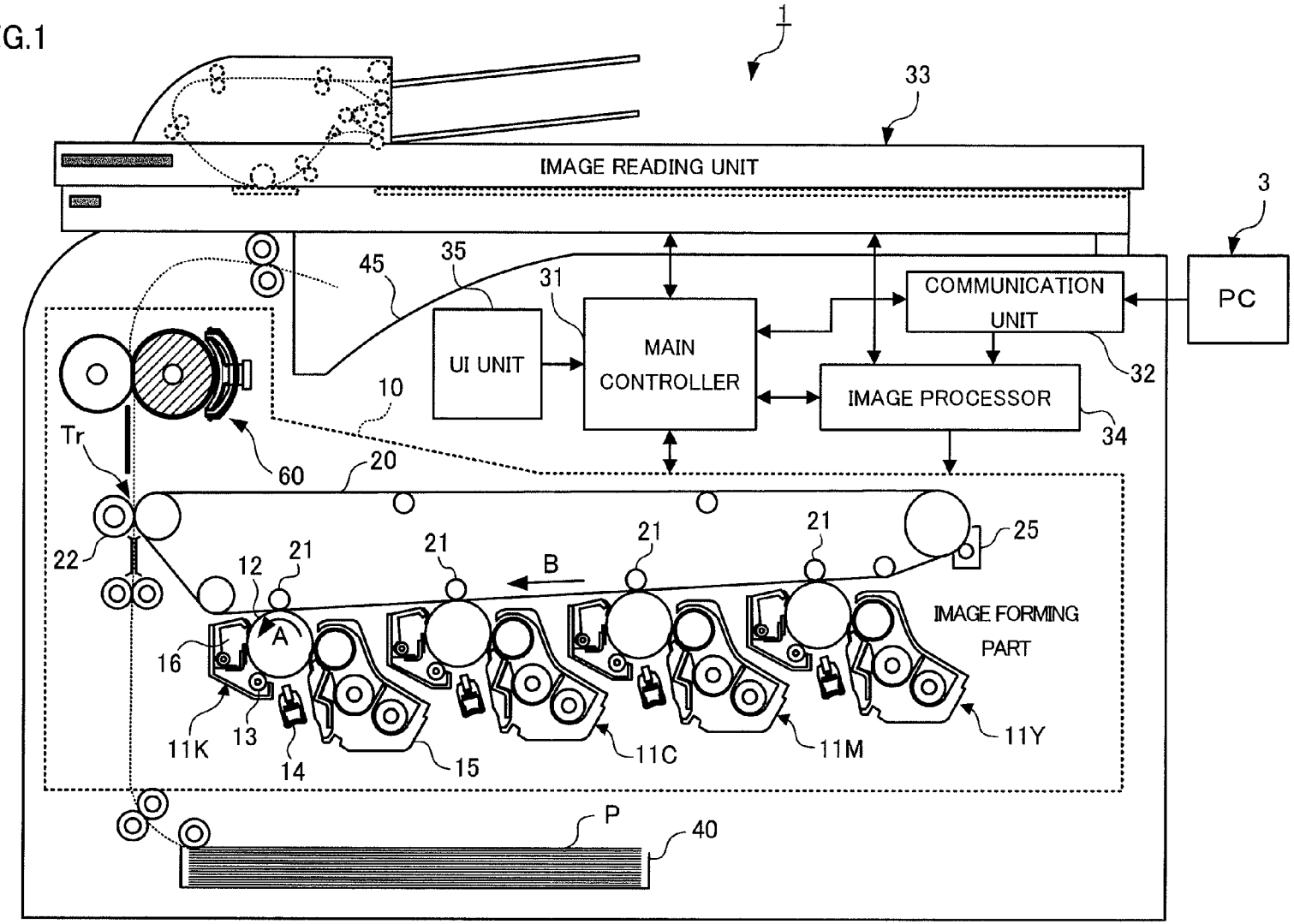
FIG. 1 is a diagram showing a configuration example of an image forming apparatus to which a fixing device (heating device) of the first exemplary embodiment is applied.

FIG. 1 is a diagram showing a configuration example of an image forming apparatus 1 to which a fixing device (a heating unit or a heating device) 60 of the first exemplary embodiment is applied. The image forming apparatus 1 shown in FIG. 1 is a so-called tandem-type color printer, and includes: an image forming part 10 that performs image formation on the basis of image data; and a main controller 31 that controls operations of the entire image forming apparatus 1. The image forming apparatus 1 further includes a communication unit 32, an image reading unit 33, an image processor 34 and a user interface (UI) unit 35. The communication unit 32 communicates with, for example, a personal computer (PC) 3 or the like to receive image data. The image reading unit 33 reads an image from a document sheet to generate read image data. The image processor 34 performs image processing set in advance on image data received by the communication unit 32, read image data generated by the image reading unit 33, or the like, and transmits processed data to the image forming part 10. The UI unit 35 receives an operation input from a user, and displays various kinds of information to the user.

The image forming part 10 is a unit to form an image by an electrophotographic method, for example, and includes four image forming units 11Y, 11M, 11C and 11K (hereinafter, referred to as "image forming units 11") as an example of toner image forming units, which are arranged side by side. Each of the image forming units 11 includes a photoconductive drum 12, a charging device 13, an exposure device 14, a developing device 15 and a drum cleaner 16, as function members. On the photoconductive drum 12, an electrostatic latent image is formed and thereafter a toner image is formed, while the photoconductive drum 12 rotates in the direction shown by an arrow A, for example. The charging device 13 charges the surface of the photoconductive drum 12 at a potential set in advance. The exposure device 14 exposes, on the basis of image data, the photoconductive drum 12 charged by the charging device 13. The developing device 15 develops the electrostatic latent image formed on the photoconductive drum 12 with color toners. The drum cleaner 16 cleans the surface of the photoconductive drum 12 after transfer.

The image forming units 11 have almost the same configuration except toner contained in the developing device 15, and form yellow (Y), magenta (M), cyan (C) and black (K) color toner images, respectively.

Further, the image forming part 10 includes: an intermediate transfer belt 20 onto which multiple layers of color toner images formed on the photoconductive drums 12 of the image forming units 11 are transferred; and primary transfer rolls 21 that sequentially transfer (primarily transfer) the color toner images formed in the respective image forming units 11 onto the intermediate transfer belt 20. Furthermore, the image forming part 10 includes: a secondary transfer roll 22 that collectively transfers (secondarily transfers) the color toner images superimposingly transferred onto the intermediate transfer belt 20, onto a sheet P that is a recording medium (recording sheet); and the fixing device 60 as an example of the heating unit (the heating device) that fixes the color toner images having been secondarily transferred, onto the sheet P. Note that, in the image forming apparatus 1 according to the exemplary embodiments, the intermediate transfer belt 20, the primary transfer rolls 21 and the secondary transfer roll 22 configure a transfer unit.

The image forming units 11 in the image forming part 10 form yellow (Y), magenta (M), cyan (C) and black (K) color toner images, respectively, by an electrophotographic process using the above-mentioned function members. The color toner images formed in the image forming units 11 are electrostatically transferred, in sequence, onto the intermediate transfer belt 20 by the primary transfer rolls 21. Then, synthetic toner images on which the color toner images are superimposed on one another are formed. The synthetic toner images on the intermediate transfer belt 20 are transported to a region (secondary transfer region Tr) at which the secondary transfer roll 22 is arranged, along with the movement of the intermediate transfer belt 20 (in the direction shown by an arrow B). Then, the superimposed toner images are collectively and electrostatically transferred onto the sheet P supplied from a sheet holding container 40. Thereafter, the synthetic toner images that are electrostatically transferred onto the sheet P are subjected to fixing processing (heating processing) by the fixing device 60, and thereby fixed onto the sheet P. Then, the sheet P including the fixed images formed thereon is transported to a sheet stack unit 45 provided at an output portion of the image forming apparatus 1, and is stacked there.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the drum cleaners 16 and a belt cleaner 25, respectively.

In this way, the image formation processing in the image forming apparatus 1 is repeatedly performed for a designated number of print sheets.

<Description of Overall Configuration of Fixing Unit>

Next, a description will be given of the fixing device 60 in the first exemplary embodiment.

Figure 2:
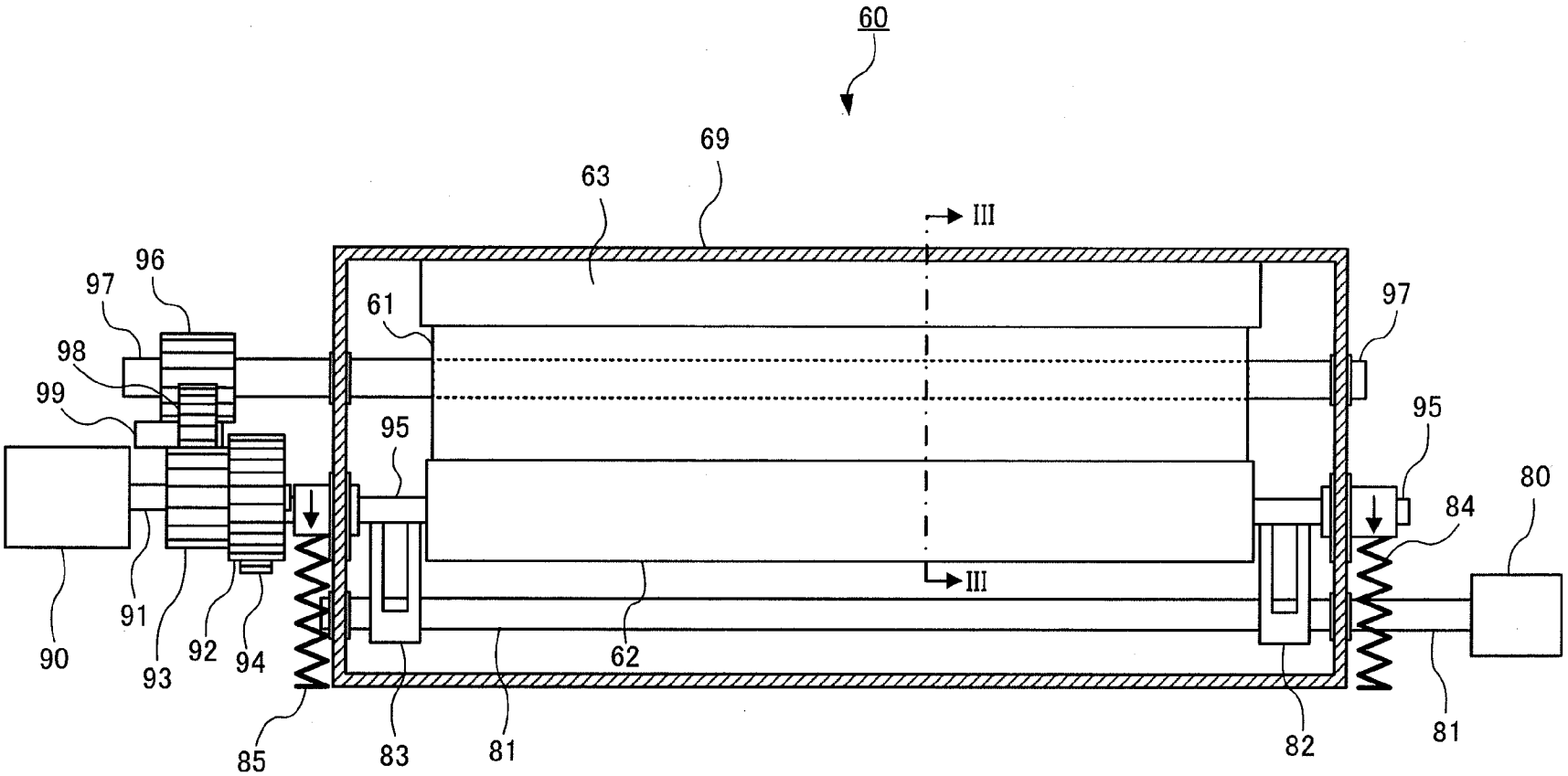
FIG. 2 is a front view illustrating a configuration of the fixing device.
Figure 3:
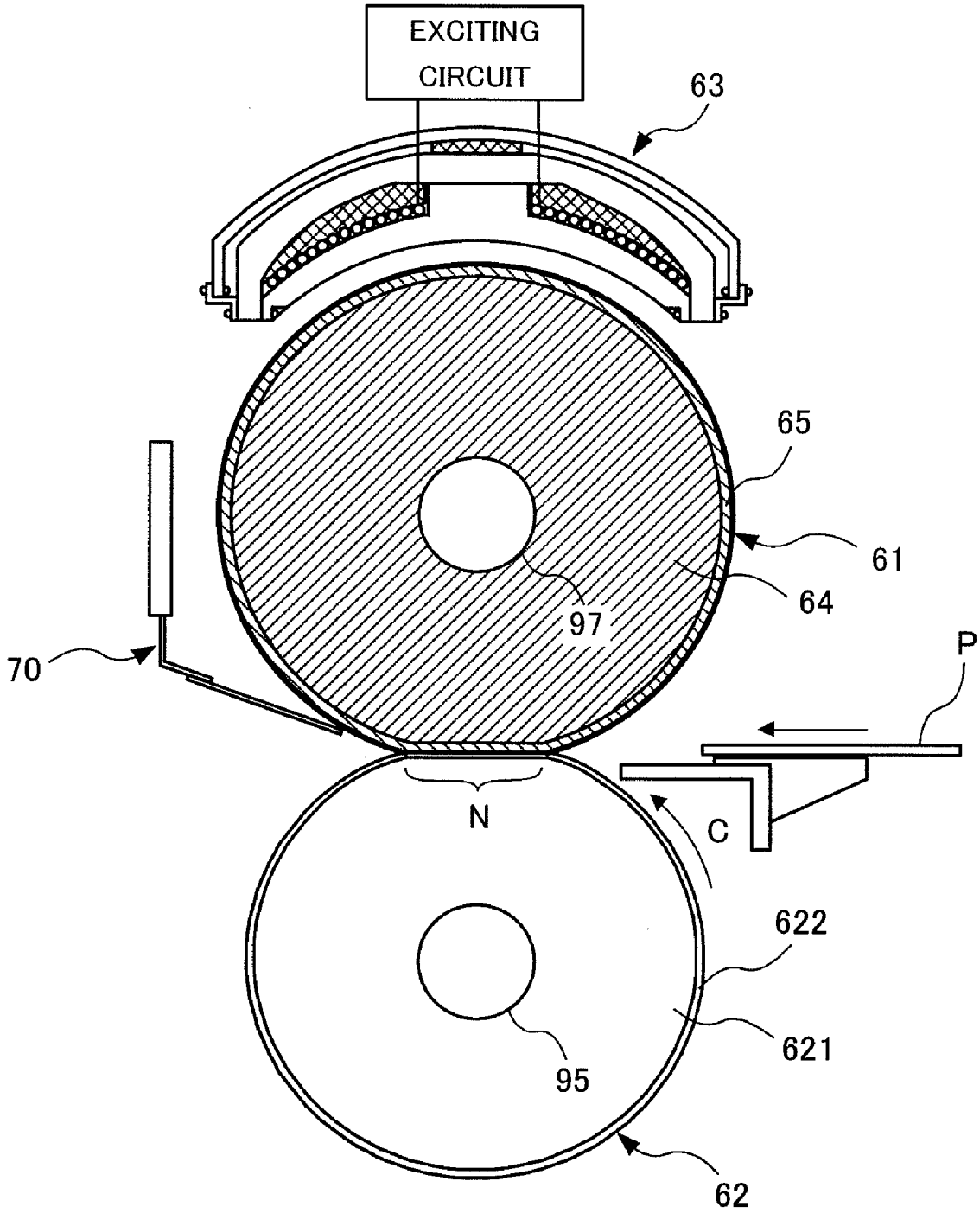
FIG. 3 is a cross sectional view illustrating the configuration of the fixing device, taken along the line III-III in FIG. 2.

FIGS. 2 and 3 are diagrams illustrating a configuration of the fixing device 60 of the first exemplary embodiment. FIG. 2 is a front view of the fixing device 60 seen from a side from which the sheet P is transported, and FIG. 3 is a cross sectional view of the fixing device 60, taken along the line III-III in FIG. 2.

As shown in FIGS. 2 and 3, inside of a support body 69 (see FIG. 2), the fixing device 60 includes: an induction heating (IH) heater 63 as an example of a magnetic field generating member that generates an AC (alternate-current) magnetic field; a fixing belt 61 as an example of a heating member that is heated through electromagnetic induction by the IH heater 63, and thereby heats (fixes) a toner image; a first elastic member 64 and a second elastic member 65 (see FIG. 3) that are arranged at an inner side of the fixing belt 61; a pressure roll 62 as an example of a pressing member that is arranged so as to face the fixing belt 61; and a peeling assisting member 70 (see FIG. 3) that assists peeling of the sheet P from the fixing belt 61.

<Description of Fixing Belt>

Figure 4:
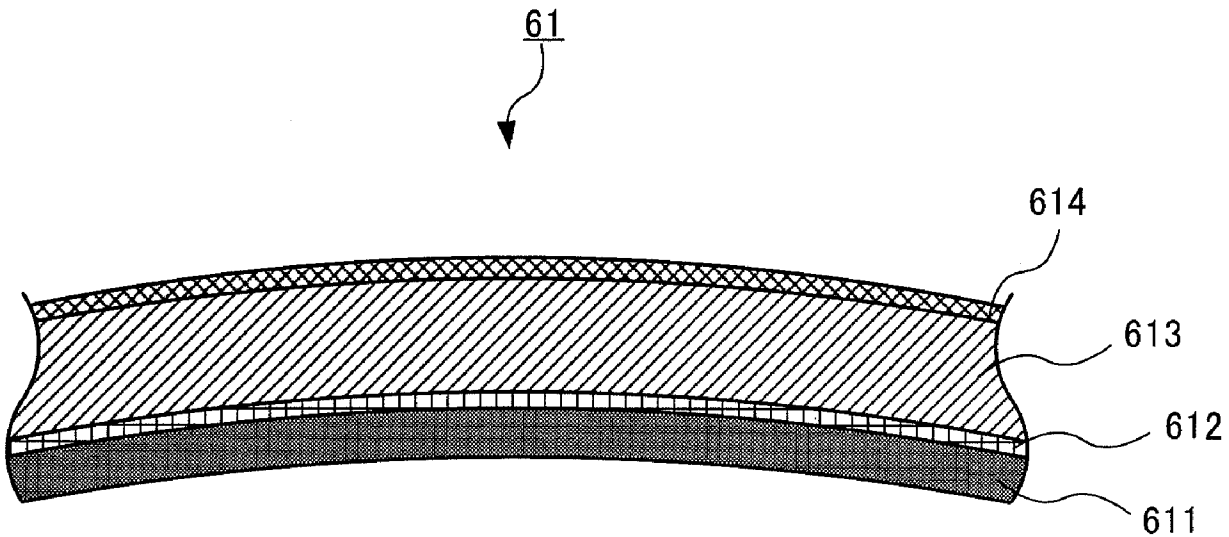
FIG. 4 is a configuration diagram showing cross sectional layers of the fixing belt.

The fixing belt 61 is formed of an endless belt member originally formed into a cylindrical shape, and is formed with a diameter of 30 mm and a width-direction length of 370 mm in the original shape (cylindrical shape), for example. In addition, as shown in FIG. 4 (a configuration diagram showing cross sectional layers of the fixing belt 61), the fixing belt 61 is formed as a multi-layer structure including: a base material layer 611; a conductive heat generation layer 612 that is stacked on the base material layer 611; an elastic layer 613 that improves fixing properties of a toner image; and a surface release layer 614 that is applied as the outermost layer.

Firstly, the base material layer 611 of the fixing belt 61 is formed of a heat-resistant sheet-like member that supports the conductive heat generation layer 612, which is a thin layer, and that gives a mechanical strength to the entire fixing belt 61. Moreover, the base material layer 611 is formed of a certain material with a certain thickness. The material has properties (relative permeability, specific resistance) that allow a magnetic field to pass therethrough. The base material layer 611 itself is formed so as not to generate heat by action of the magnetic field or not to easily generate heat. Specifically, for example, a non-magnetic metal such as a non-magnetic stainless steel having a thickness of 30 μm to 200 μm, or a resin material or the like having a thickness of 60 μm to 200 μm is used as the base material layer 611.

The conductive heat generation layer 612 of the fixing belt 61 is an example of a heat generation layer and is an electromagnetic induction heat-generating layer that is heated through electromagnetic induction of the AC magnetic field generated at the IH heater 63. Specifically, the conductive heat generation layer 612 is a layer that generates an eddy current when the AC magnetic field from the IH heater 63 passes therethrough in the thickness direction.

A frequency of the AC magnetic field generated by the IH heater 63 ranges from 20 kHz to 100 kHz by use of the general-purpose power supply. Accordingly, the conductive heat generation layer 612 is formed to allow the AC magnetic field having a frequency of 20 kHz to 100 kHz to enter and to pass therethrough. As the material that forms the conductive heat generation layer 612, a metal such as Au, Ag, Al, Cu, Zn, Sn, Pb, Bi, Be or Sb, or a metal alloy including at least one of these elements is used, for example.

Specifically, as the configuration of the conductive heat generation layer 612, a non-magnetic metal (paramagnet having a relative permeability substantially equal to 1) including Cu or the like, having a thickness of 2 μm to 20 μm and a specific resistance value not greater than $2.7\times10^{-8}$ ••m is used, for example. In addition, in view of shortening the time (hereinafter, referred to as "warm-up time") required for heating the fixing belt 61 up to a fixable temperature, the conductive heat generation layer 612 is formed of a thin layer to have a small heat capacity.

Next, the elastic layer 613 of the fixing belt 61 is formed of a heat-resistant elastic material such as silicone rubber. The toner image to be held on the sheet P, which is to become the fixation target, is formed of a multi-layer of color toner as powder. For this reason, in order to uniformly supply heat to the entire toner image at a nip portion N, the elastic layer 613 is formed so as to deform along with unevenness of the toner image on the sheet P. For example, silicone rubber having a thickness of 100 μm to 600 μm and a hardness of 10° to 30° (JIS-A) is used for the elastic layer 613.

The surface release layer 614 of the fixing belt 61 directly contacts with an unfixed toner image held on the sheet P. Accordingly, a material with a high releasing property for a toner is used. For example, a PFA (a copolymer of tetrafluoroethylene and perfluoroalkylvinylether) layer, a PTFE (polytetrafluoroethylene) layer, a silicone copolymer layer or a composite layer formed of these layers is used. As to the thickness of the surface release layer 614, if the thickness is too small, no sufficient wear resistance is obtained, hence, reducing the lifetime of the fixing belt 61. On the other hand, if the thickness is too large, the heat capacity of the fixing belt 61 becomes so large that the warm-up time becomes longer. In this respect, the thickness of the surface release layer 614 is set at 1 μm to 50 μm in consideration of the balance between the wear resistance and heat capacity.

Note that the fixing belt 61 may have a one-layer structure formed of a single material. For example, the fixing belt 61 may be formed of one layer that is formed of a metal, such as Ni, having a thickness of about 50 μm.

<Description of First Elastic Member and Second Elastic Member>

In the fixing device 60 of the first exemplary embodiment, the first elastic member 64 and the second elastic member 65 are arranged at the inner side of the fixing belt 61 to extend over the entire width of the fixing belt 61. The first elastic member 64 is formed of a cylindrical roll that is formed of an elastic body of rubber, elastomer or the like (for example, silicone rubber) having a rubber hardness of 25° to 45° (JIS-A), for example, and that has an outer diameter of 29 mm. The first elastic member 64 is fitted and fixed (bonded) onto a rotation shaft 97 of the fixing belt 61.

The second elastic member 65 is formed of an elastic body (sponge layer) having a rubber hardness lower than that of the elastic body forming the first elastic member 64. The second elastic member 65 is formed of, for example, an elastic body obtained by foaming silicone rubber and having a rubber hardness of 15° to 35° (JIS-A). Specifically, the expansion ratio and the rubber hardness of the second elastic member 65 are selected in such a way that the elastic deformation ratio of the second elastic member 65 with respect to the pressure (nip pressure) at the nip portion N becomes larger than that of the first elastic member 64. Here, the nip portion N is the region where the pressure roll 62 is in pressure contact with the fixing belt 61 (in contact with the fixing belt 61 while pressing it). The "elastic deformation ratio" herein refers to the amount of elastic deformation per unit volume when the nip pressure acts on the nip portion N.

The second elastic member 65 is formed with a layer thickness of 0.5 mm to 1 mm, for example, and is adhered to the first elastic member 64 in such a way that the inner circumferential surface of the second elastic member 65 covers the outer circumferential surface of the first elastic member 64. Meanwhile, the outer surface of the second elastic member 65 is adhered to the inner circumferential surface of the fixing belt 61. In the manner described above, the fixing belt 61 has a configuration in which the rotation shaft 97, the first elastic member 64 and the second elastic member 65 are integrally formed into an elastic roll, which is fitted into the inner side of the fixing belt 61. The fixing belt 61 having this configuration is rotationally driven along with rotation of the rotation shaft 97.

In this case, the elastic roll (the rotation shaft 97, the first elastic member 64 and the second elastic member 65) that is fitted into the inner side of the fixing belt 61 is formed in such a way that the outer diameter (outer diameter of the outer surface of the second elastic member 65) of the elastic roll is slightly larger than the diameter of the fixing belt 61 in the original shape (cylindrical shape) (30 mm, for example). With this configuration, the adhesiveness between the outer surface of the second elastic member 65 and the inner circumferential surface of the fixing belt 61 is increased. For example, the second elastic member 65 having a layer thickness of 1 mm is applied onto the first elastic member 64 having an outer diameter of 29 mm (the outer diameter of the elastic roll is thus 31 mm). Accordingly, the elastic roll is configured in such a way that the outer diameter of the outer surface of the second elastic member 65 is by approximately 1 mm larger than the diameter of the fixing belt 61 in the original shape, which is 30 mm. In this manner, the elastic force acting from the elastic roll increases the adhesiveness between the elastic roll and the fixing belt 61.

Figure 8A:
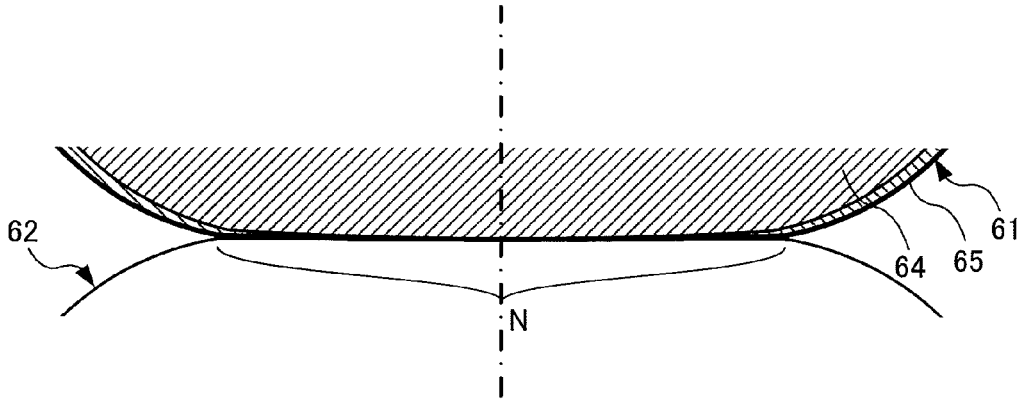
FIGS. 8A and 8B are diagrams showing the states of the fixing belt in a region in the vicinity of the nip portion.
Figure 8B:
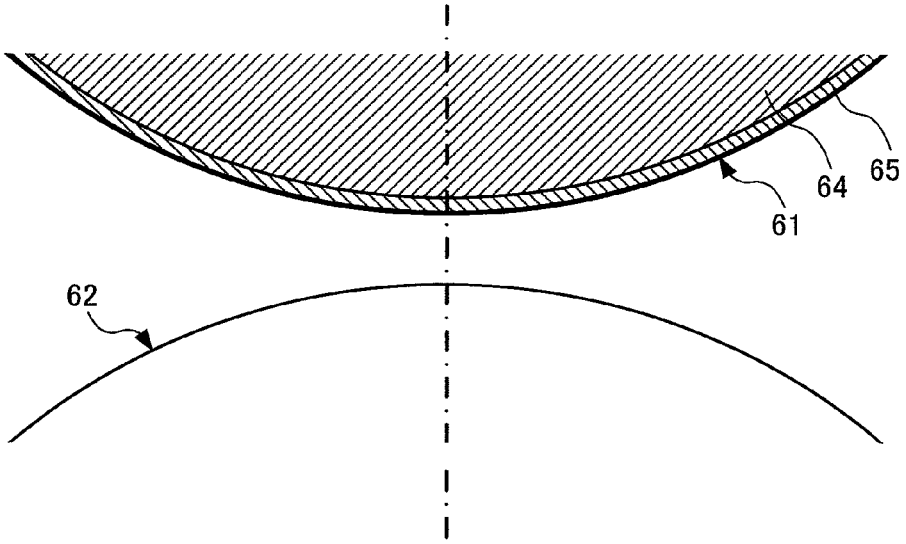

With this configuration, when the pressure roll 62 is arranged in pressure contact with the fixing belt 61 (in contact with the fixing belt 61 while pressing it) by a contacting/separating mechanism to be described later, the fixing belt 61 forms the nip portion N with the pressure roll 62 mainly by the elastic forces of both of the first elastic member 64 and the pressure roll 62. Meanwhile, when the pressure roll 62 is arranged apart from the fixing belt 61 by the contacting/separating mechanism, the entire shape of the fixing belt 61 is restored to the original shape (cylindrical shape). Note that, the functions of the first elastic member 64 and the second elastic member 65 will be described in detail later (FIGS. 8A and 8B).

Figure 6A:
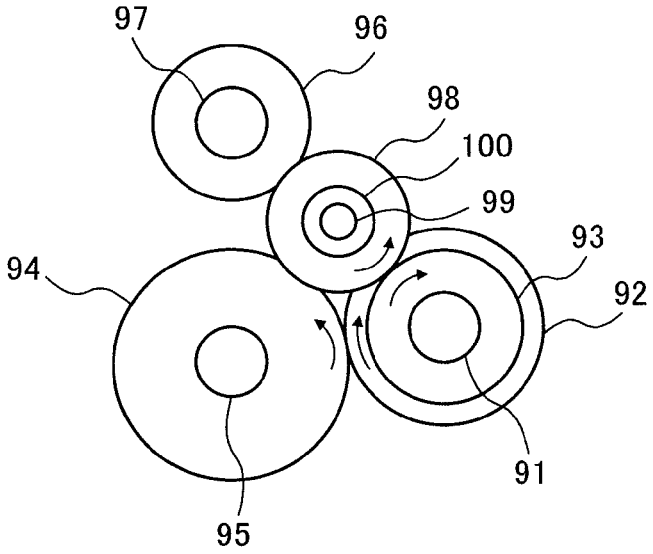
FIGS. 6A and 6B are diagrams illustrating how the drive force is transmitted from the drive motor to the fixing belt and the pressure roll.
Figure 6B:
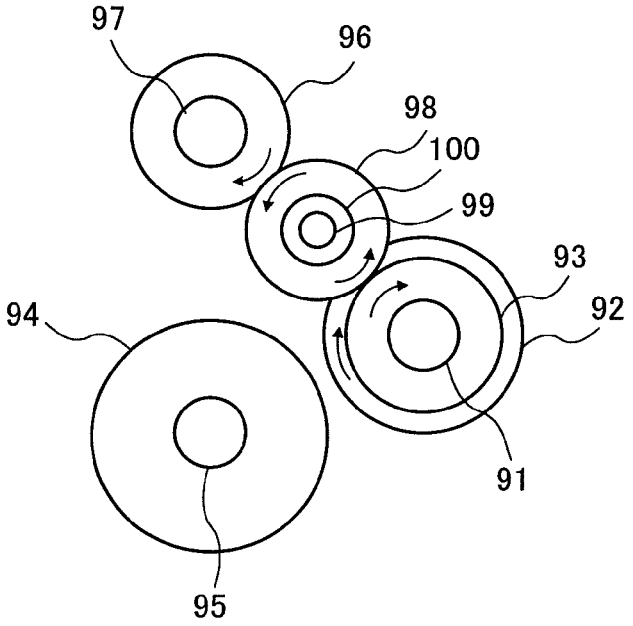

In addition, as shown in FIG. 2, a drive transmission gear 96 is fixed to one of the end portions of the rotation shaft 97 of the fixing belt 61 having the above-mentioned configuration. Meanwhile, the rotation shaft 97 is supported by the support body 69 so as to be rotatable. Then, in a state where the pressure roll 62 is brought into pressure contact with the fixing belt 61 by the contacting/separating mechanism, the fixing belt 61 is driven to rotate by the frictional force from the pressure roll 62 while no rotational drive force from a drive motor 90 is transmitted to the drive transmission gear 96. Meanwhile, in a state where the fixing belt 61 is separated from the pressure roll 62, a rotational drive force from the drive motor 90 is transmitted to the drive transmission gear 96, and the fixing belt 61 rotates without any frictional force. Note that, the mechanism to drive the fixing belt 61 and the pressure roll 62 will be described in detail later (FIGS. 6A and 6B).

<Description of Pressure Roll>

As shown in FIG. 3, the pressure roll 62 is configured of a heat resistant elastic layer 621 and a release layer 622. The heat resistant elastic layer 621 is formed of foamed silicone rubber or the like, for example. The release layer 622 is formed of a heat resistant resin coating, such as PFA mixed with carbon, or a heat resistant rubber coating having a thickness of 50 •m, for example. In addition, the pressure roll 62 is formed with a 28 mm diameter and a 380 mm length in the width direction. The pressure roll 62 is arranged along the direction of the rotation shaft 97 of the fixing belt 61 so as to be in parallel with the fixing belt 61. As to be described later, the pressure roll 62 is configured to be caused to come into contact with or to separate from the fixing belt 61 by the contacting/separating mechanism.

In addition, as shown in FIG. 2 (also, see FIGS. 6A and 6B to be described later), a rotation shaft 95 is provided to the pressure roll 62 so as to penetrate through the rotation center of the pressure roll 62. Then, a drive transmission gear 94 is fixed to one of the end portions of the rotation shaft 95. In addition, the rotation shaft 95 is supported by the support body 69 so as to be rotatable and also to be movable within a predetermined range in the support body 69 in the direction of the fixing belt 61. In this manner, when the pressure roll 62 is arranged at a position where the pressure roll 62 is in pressure contact with the fixing belt 61 by the contacting/separating mechanism, the pressure roll 62 receives a drive force, via the drive transmission gear 94, from the drive motor 90, which is the drive source, and then rotate itself in the direction shown by arrow C in FIG. 3. Thereby, the fixing belt 61 is driven by the pressure roll 62 to rotate. At this time, while pressing the fixing belt 61, the pressure roll 62 forms the nip portion N at the position where the pressure roll 62 is in contact with the fixing belt 61. Then, the sheet P holding unfixed toner images are caused to pass through the nip portion N. Thereby, the unfixed toner images are fixed onto the sheet P by heat and pressure.

<Description of Contacting/Separating Mechanism of Pressure Roll>

Here, a description will be given of the contacting/separating mechanism (hereinafter, referred to as a "retract mechanism") as an example of a contacting/separating unit that causes the pressure roll 62 to come into contact with and to separate from the fixing belt 61.

As shown in FIG. 2, the fixing device 60 of the first exemplary embodiment includes, as the retract mechanism, a rotation shaft 81, a displacement motor 80, and cams 82 and 83. The rotation shaft 81 is rotatably supported by the support body 69. The displacement motor 80 displaces the rotation shaft 81 within a predetermined range of angle. The cams 82 and 83 are respectively fixed to positions that are end regions of the rotation shaft 81 and face the rotation shaft 95 of the pressure roll 62. The cams 82 and 83 swing when the rotation shaft 81 is displaced. The fixing device 60 further includes, as the retract mechanism, springs 84 and 85 that are connected to both end regions of the rotation shaft 95 of the pressure roll 62, respectively, and bias the pressure roll 62 in the direction in which the pressure roll 62 is separated from the fixing belt 61 (direction indicated by arrows).

Figure 5B:
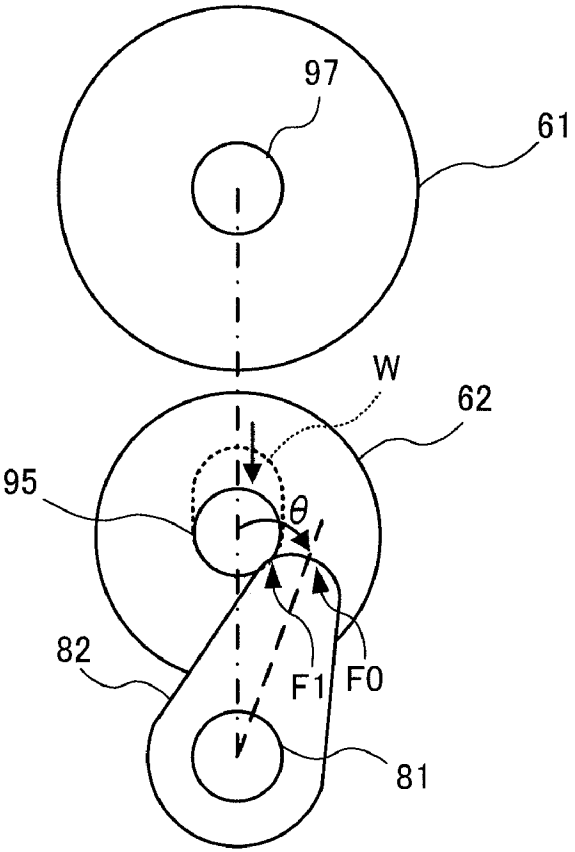
FIGS. 5A and 5B are diagrams illustrating an operation to be performed by the retract mechanism when the retract mechanism causes the pressure roll to come into contact with and to separate from the fixing belt.
Figure 5A:
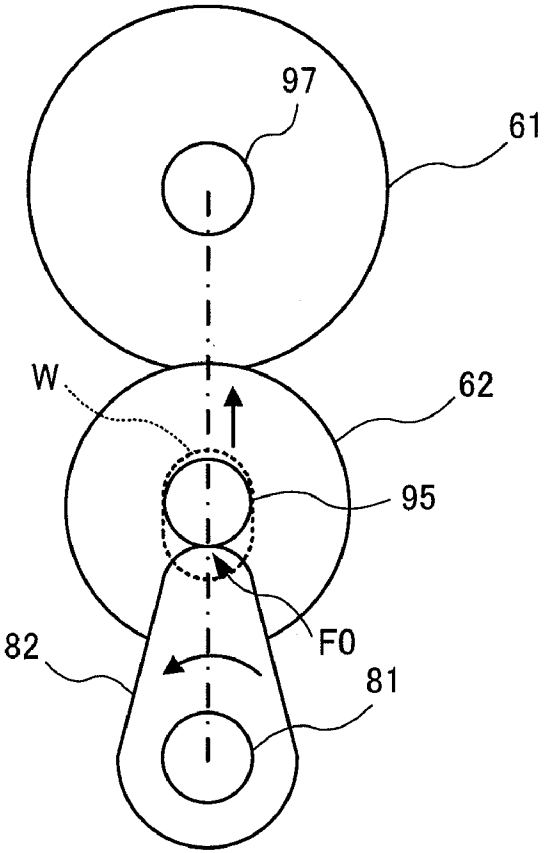

Next, FIGS. 5A and 5B are diagrams illustrating an operation to be performed by the retract mechanism when the retract mechanism causes the pressure roll 62 to come into contact with or to separate from the fixing belt 61. Firstly, as shown in FIG. 5A, in a state where the displacement motor 80 displaces the rotation shaft 81 in order for an apex F0 of each of the cams 82 and 83 (only the cam 82 is illustrated in FIGS. 5A and 5B) to be directed in the direction of the rotation shaft 97 of the fixing belt 61, the apex F0 of the cam 82 (cam 83) presses the rotation shaft 95 of the pressure roll 62 toward the fixing belt 61 (direction shown by an arrow) while resisting to the biasing force from the springs 84 and 85. Thereby, the pressure roll 62 is set at a position where the pressure roll 62 presses the first elastic member 64 and the second elastic member 65 via the fixing belt 61.

Subsequently, as shown in FIG. 5B, in a state where the displacement motor 80 displaces the rotation shaft 81 in order for the apex F0 of the cam 82 (cam 83) to be inclined from the direction toward the rotation shaft 97 of the fixing belt 61 only by an angle •, the rotation shaft 95 of the pressure roll 62 moves, along a side surface F1 of the cam 82 (cam 83) due to the biasing force of the springs 84 and 85 (see FIG. 2), in the direction (direction shown by an arrow in FIG. 5B) to separate from the fixing belt 61 in the range of a movement restriction area W set at the support body 69. Thereby, the pressure roll 62 is set at the position where the pressure roll 62 is separated from the fixing belt 61.

As described above, the pressure roll 62 is operated to come into contact with or to separate from the fixing belt 61 by the retract mechanism. The retract mechanism performs the operation for the pressure roll 62 to come into contact with or to separate from the fixing belt 61 when a fixing operation starts or ends in the fixing device 60. Specifically, the pressure roll 62 is set to be in pressure contact with the fixing belt 61 (in contact with the fixing belt 61 while pressing it) when a fixing operation starts. Thereby, the pressure roll 62 having received the rotational drive force from the drive motor 90 (see FIG. 2) drives the fixing belt 61 to rotate during the fixing operation. In addition, before the fixing operation starts, the pressure roll 62 remains in a state where the pressure roll 62 is separated from the fixing belt 61. In this state, an operation to rotate the fixing belt 61 to raise the temperature of the fixing belt 61 up to a fixable temperature by the IH heater 63 (hereinafter, referred to as a "warm-up operation") is performed.

<Description of Drive Mechanism of Fixing Belt>

Next, a description will be given of a mechanism to drive the fixing belt 61 and the pressure roll 62 (hereinafter, referred to as a "drive mechanism").

Firstly, as shown in FIG. 2 described above, the fixing device 60 of the first exemplary embodiment includes, as the drive mechanism, the drive motor 90 and drive transmission gears 92 and 93, and the drive transmission gears 94 and 96. The drive motor 90 serves as the drive source. The drive transmission gears 92 and 93 are fixed to a rotation shaft 91 of the drive motor 90. The drive transmission gear 94 is fixed to the rotation shaft 95 of the pressure roll 62. The drive transmission gear 96 is fixed to the rotation shaft 97 of the fixing belt 61. The fixing device 60 further includes a transmission gear 98 that connects the drive transmission gear 96 on the fixing belt 61 to the drive transmission gear 93 on the drive motor 90. The transmission gear 98 is supported by a rotation shaft 99 via a torque limiter 100 (see FIGS. 6A and 6B to be described later).

Next, a description will be given of a transmission path of the drive force from the drive motor 90 in the drive mechanism of the fixing device 60. As described above, since the pressure roll 62 is operated to come into contact with or to separate from the fixing belt 61 by the retract mechanism, the drive force from the drive motor 90 is transmitted through a different path between a state where the pressure roll 62 is in pressure contact with the fixing belt 61 and a state where the pressure roll 62 is separated from the fixing belt 61.

FIGS. 6A and 6B are diagrams illustrating how the drive force is transmitted from the drive motor 90 to the fixing belt 61 and the pressure roll 62. FIG. 6A shows how the drive force is transmitted in the state where the pressure roll 62 is brought into pressure contact with the fixing belt 61 by the retract mechanism. FIG. 6B shows how the drive force is transmitted in the state where the pressure roll 62 is separated from the fixing belt 61 by the retract mechanism.

As shown in FIG. 6A, in the state where the pressure roll 62 is in pressure contact with the fixing belt 61 (see FIG. 5A), the drive transmission gear 92, which is fixed to the rotation shaft 91 of the drive motor 90, is engaged with the drive transmission gear 94 on the pressure roll 62. In addition, the drive transmission gear 93, which is fixed to the rotation shaft 91 of the drive motor 90, is engaged with the transmission gear 98 engaged with the drive transmission gear 96 on the fixing belt 61.

In this case, because of the engagement between the drive transmission gear 92 and the drive transmission gear 94, the rotational drive force from the drive motor 90 is transmitted to the pressure roll 62 via the drive transmission gear 92 and the drive transmission gear 94, and thereby, the pressure roll 62 is rotationally driven. Then, the pressure roll 62 drives and rotates the fixing belt 61.

Meanwhile, because of the engagement between the drive transmission gear 93 and the transmission gear 98, the rotational drive force from the drive motor 90 is also transmitted to the transmission gear 98 via the drive transmission gear 93. In this case, however, the fixing belt 61 to which the transmission gear 98 is to transmit the rotational drive force via the drive transmission gear 96 is already driven and rotated by the pressure roll 62. Moreover, the gear ratio set between the drive transmission gear 92 on the drive motor 90 and the drive transmission gear 94 on the pressure roll 62 is configured to rotate the fixing belt 61 slightly faster (approximately 1% to 3%, for example) than the gear ratio set among the drive transmission gear 93 on the drive motor 90, the transmission gear 98, and the drive transmission gear 96 on the fixing belt 61. For this reason, in this case, the drive transmission gear 96 on the fixing belt 61 to which the transmission gear 98 is to transmit the rotational drive force rotates at a rotation speed faster than that of the transmission gear 98. Accordingly, the transmission gear 98 rotates freely by the torque limiter 100 arranged between the transmission gear 98 and the rotation shaft 99. Thus, the rotational drive force from the drive transmission gear 93 on the drive motor 90 is not transmitted to the drive transmission gear 96 on the fixing belt 61.

In the manner described above, the rotational drive force from the drive motor 90 is transmitted only to the pressure roll 62 in the state shown in FIG. 6A, where the pressure roll 62 is in pressure contact with the fixing belt 61. Then, the fixing belt 61 is driven and rotated by the pressure roll 62, so that the rotation speed of the fixing belt 61 is set by the pressure roll 62 alone. Thus, the rotation speed of the fixing belt 61 becomes stable.

On the other hand, as shown in FIG. 6B, in the state where the pressure roll 62 is separated from the fixing belt 61, the engagement state between the drive transmission gear 92 on the drive motor 90 and the drive transmission gear 94 on the pressure roll 62 is released. For this reason, the rotational drive force from the drive motor 90 is not transmitted to the pressure roll 62, so that the fixing belt 61 receives no rotational force from the pressure roll 62. Accordingly, in this case, the transmission gear 98 transmits the rotational drive force from the drive transmission gear 93 on the drive motor 90 to the drive transmission gear 96 on the fixing belt 61. Thereby, the rotational drive force from the drive motor 90 is transmitted from the drive transmission gear 96 on the fixing belt 61 to the rotation shaft 97. Further, the rotational drive force is transmitted to the fixing belt 61 via the first elastic member 64 and the second elastic member 65, which are bonded to the rotation shaft 97, so that the fixing belt 61 itself is directly rotated.

In the manner described above, in the fixing device 60 of the first exemplary embodiment, in a case where the fixing operation has not been started yet and the pressure roll 62 is set in a state where the pressure roll 62 is not brought into pressure contact with the fixing belt 61 by the retract mechanism, the fixing belt 61 is rotationally driven directly by the rotational drive force from the drive motor 90.

On the other hand, in the state where the fixing operation has been started and the pressure roll 62 is brought into pressure contact with the fixing belt 61 by the retract mechanism, the fixing belt 61 rotates indirectly, following the rotation of the pressure roll 62 rotated by the rotational drive force from the drive motor 90.

<Description of IH Heater>

Next, a description will be given of the IH heater 63, which heats the conductive heat generation layer 612 of the fixing belt 61 through electromagnetic induction by causing an AC magnetic field to act on the conductive heat generation layer 612.

Figure 7:
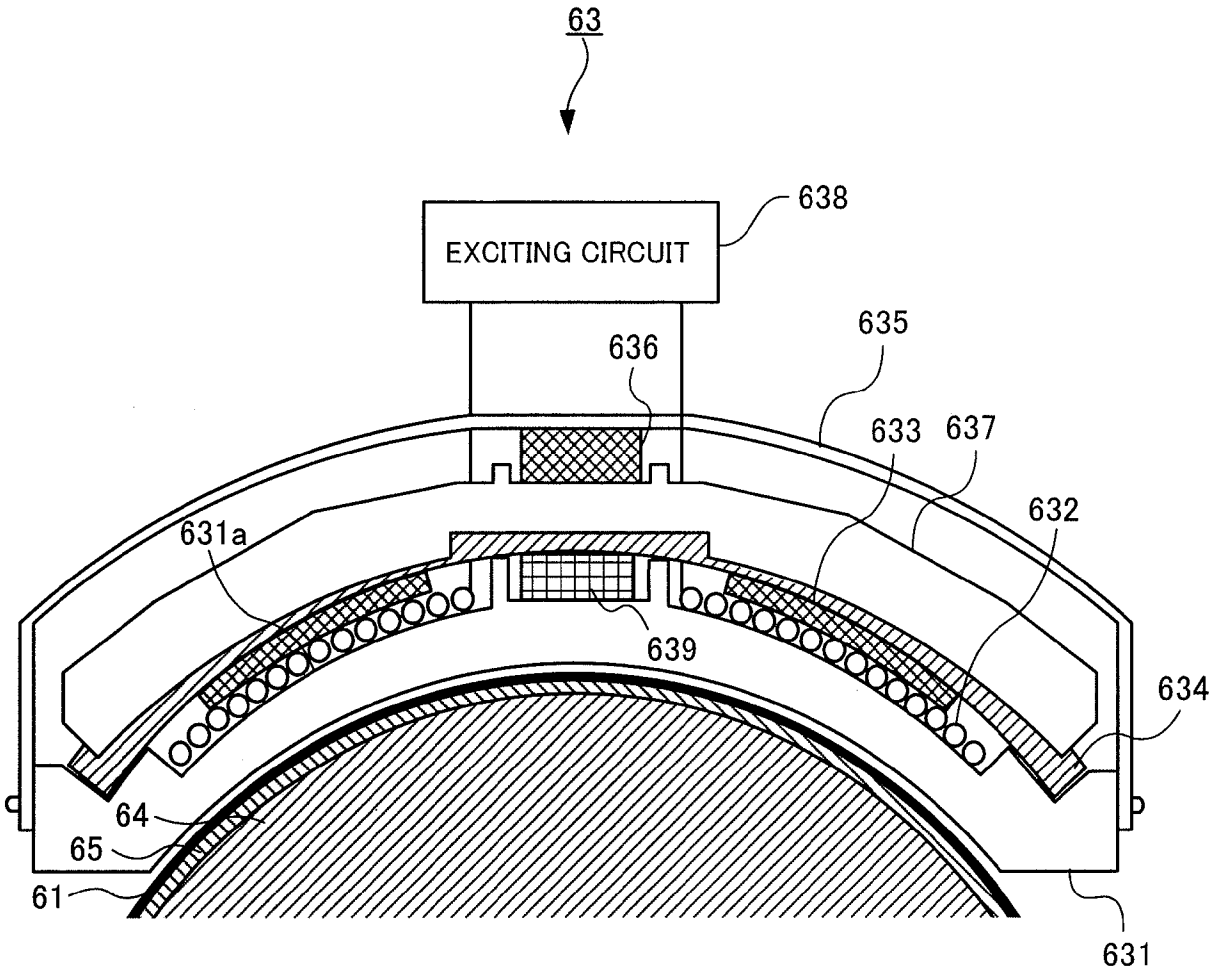
FIG. 7 is a cross-sectional view illustrating a configuration of the IH heater.

FIG. 7 is a cross-sectional view illustrating a configuration of the IH heater 63 of the first exemplary embodiment. As shown in FIG. 7, the IH heater 63 includes a support body 631, an exciting coil 632, elastic support members 633, and plural magnetic cores 634. The support body 631 is formed of a nonmagnetic material, such as heat-resistant resin, for example. The exciting coil 632 generates the AC magnetic field. Each of the elastic support members 633 is formed of an elastic material, such as silicone rubber, for example, and fixes the exciting coil 632 onto the support body 631. The plural magnetic cores 634 are arranged along the width direction of the fixing belt 61 and form a magnetic path of the AC magnetic field generated by the exciting coil 632. The IH heater 63 further includes plural adjustment magnetic cores 639, magnetic core holding members 637, a pressure member 636, a shield 635 and an exciting circuit 638. The plural adjustment magnetic cores 639 are arranged in the width direction of the fixing belt 61 so as to even out, in the longitudinal direction of the support body 631, the AC magnetic field generated by the exciting coil 632. The magnetic core holding members 637 hold the magnetic cores 634 so as to cover the magnetic cores 634 from above. The pressure member 636 pressurizes the magnetic cores 634 towards the support body 631 via the magnetic core holding members 637, and is formed of an elastic body, such as silicone rubber, for example. The shield 635 blocks the magnetic field and suppresses leakage of the magnetic field to the outside of the IH heater 63. The exciting circuit 638 supplies an AC current to the exciting coil 632.

The support body 631 is formed of a heat-resistant nonmagnetic material, such as heat-resistant resin including heat-resistant glass, polycarbonate, PPS (polyphenylene sulfide) and the like, or heat-resistant resin obtained by blending a glass fiber into these materials, for example. The support body 631 is formed in such a way that the cross section thereof has a shape that curves along the surface shape of the fixing belt 61. In addition, the support body 631 is formed and set so as to keep a predetermined distance (0.5 mm to 2 mm, for example) between a support surface 631*a*, which supports the exciting coil 632, and the surface of the fixing belt 61.

The exciting coil 632 is configured of a litz wire that is wound into a hollow closed loop shape, such as an oval shape, elliptical shape, and rectangular shape. The litz wire is obtained by bundling ninety, for example, copper wires each of which has a diameter of 0.17 mm, for example, and which are isolated from each other. When the exciting circuit 638 supplies the exciting coil 632 with an AC current of a predetermined frequency, an AC magnetic field around the litz wire wound into the closed loop shape is generated around the exciting coil 632. As the frequency of the AC current to be supplied from the exciting circuit 638 to the exciting coil 632, a frequency of 20 kHz to 100 kHz, which is generated by a general-purpose power supply, is used.

The elastic support member 633 is a sheet shaped member formed of an elastic body, such as silicone rubber and fluorine rubber, for example. The elastic support member 633 is set so as to press the exciting coil 632 against the support body 631 in order for the exciting coil 632 to be closely fixed to the support surface 631*a* of the support body 631.

A circular arc shaped ferromagnetic material is used for the magnetic core 634. The ferromagnetic material herein is formed of a highly-permeable oxide or an alloy material, such as sintered ferrite, ferrite resin, permalloy, and a temperature-sensitive magnetic alloy, for example. The magnetic core 634 guides the magnetic field lines (magnetic flux) of the AC magnetic field generated by the exciting coil 632 into the inside so as to form a path (closed magnetic path) of the magnetic field lines going across the fixing belt 61 from the magnetic cores 634 and then returning to the magnetic core 634. In this manner, magnetic field lines H of the AC magnetic field generated by the exciting coil 632 are concentrated in a region of the fixing belt 61. Here, the region faces the magnetic core 634.

Each of the magnetic core holding members 637 is formed of a nonmagnetic material, such as SUS and resin, and holds a corresponding one of the magnetic cores 634 so as to cover a part of or all of the corresponding one of the magnetic cores 634.

As for the adjustment magnetic cores 639, a rectangular solid (block shape) ferromagnetic material is used. The rectangular solid ferromagnetic material herein is formed of a highly-permeable material, such as sintered ferrite and ferrite resin, for example. The adjustment magnetic cores 639 even out variations in the intensity of the AC magnetic field formed by the magnetic cores 634, which variations occur in the longitudinal direction (the width direction of the fixing belt 61) of the support body 631. The adjustment magnetic cores 639 thereby reduce unevenness in the temperature (variations in the temperature or temperature ripple) in the width direction of the fixing belt 61.

In the manner described above, the IH heater 63 generates the magnetic field lines H, which go across the fixing belt 61 in the thickness direction, and thereby generates an eddy current I proportional to the amount of change in the number of the magnetic field lines H per unit volume (density of the magnetic flux) in the conductive heat generation layer 612 of the fixing belt 61. In this manner, the IH heater 63 generates a Joule heat W ($W=I^2R$), which is the product of a specific resistance value R of the conductive heat generation layer 612 and the square of the eddy current I, and thereby heats the fixing belt 61.

<Description of Function of First Elastic Member and Second Elastic Member>

Next, a description will be given of a function of the first elastic member 64 and the second elastic member 65 which are arranged at the inner side of the fixing belt 61.

As described above, the fixing device 60 of the first exemplary embodiment includes the retract mechanism, which brings the pressure roll 62 to be in contact with or to separate from the fixing belt 61. When the operation to raise the temperature of the fixing belt 61 up to the fixable temperature by the IH heater 63 (warm-up operation) is performed before the fixing operation is started, the pressure roll 62 is set at a position where the pressure roll 62 is separated from the fixing belt 61 by the retract mechanism. In this manner, the fixing belt 61 is efficiently heated by setting up a situation where heat leakage from the fixing belt 61 having a small heat capacity to the pressure roll 62 is unlikely to occur. Then, the amount of time required for raising the temperature of the fixing belt 61 up to the fixable temperature (hereinafter, referred to as "warm-up time") is reduced. Here, during the warm-up operation, the fixing belt 61 is rotationally driven directly by the rotational drive force from the drive motor 90 by the action of the above-mentioned drive mechanism.

Meanwhile, the pressure roll 62 is brought into pressure contact with the fixing belt 61 by the retract mechanism at timing when the temperature of the fixing belt 61 reaches a predetermined temperature by the warm-up operation. The predetermined temperature herein is a temperature near the fixable temperature but below the fixable temperature. At this time, the fixing belt 61 is driven and rotated by the pressure roll 62 rotating due to the rotational drive force from the drive motor 90 by the above-mentioned drive mechanism. Accordingly, the heat flows out from the fixing belt 61 to the pressure roll 62. In this state, however, the temperature of the fixing belt 61 has already reached near the fixable temperature. Thus, the heating of the fixing belt 61 up to the fixable temperature by the electromagnetic induction heating by the IH heater 63 continues while the fixing belt 61 transfers the heat to the pressure roll 62. Then, the temperature of the fixing belt 61 eventually reaches the fixable temperature. When the temperature of the fixing belt 61 reaches the fixable temperature, the sheet P is transported to the nip portion N, and the fixing operation is started.

Here, as described above, in the fixing device 60 of the first exemplary embodiment, the first elastic member 64 and the second elastic member 65 are arranged at the inner side of the fixing belt 61 so as to extend over the entire width of the fixing belt 61. During the fixing operation, the pressure roll 62 is arranged in pressure contact with the fixing belt 61 by the retract mechanism, so that the fixing belt 61 forms the nip portion N with the pressure roll 62 mainly by the elastic forces of both of the first elastic member 64 and the pressure roll 62. On the other hand, during the warm-up operation, the pressure roll 62 is arranged apart from the fixing belt 61 by the retract mechanism, so that the shape of the entire fixing belt 61 (the second elastic member 65 at the nip portion N, in particular) is restored to the original shape. Thereby, the configuration in which the second elastic member 65 is interposed between the fixing belt 61 and the first elastic member 64 is formed.

Next, FIGS. 8A and 8B are diagrams showing the states of the fixing belt 61 in a region in the vicinity of the nip portion N. FIG. 8A shows the state where the pressure roll 62 is in pressure contact with the fixing belt 61, while FIG. 8B shows the state where the pressure roll 62 is separated from the fixing belt 61.

As shown in FIG. 8A, during the fixing operation, the pressure roll 62 is arranged in pressure contact with the fixing belt 61 by the retract mechanism. In this state, the second elastic member 65 is configured to have a larger elastic deformation ratio to the nip pressure at the nip portion N than that of the first elastic member 64. Specifically, the second elastic member 65 is formed to be a thin layer (0.5 mm to 1 mm) with respect to the outer diameter (29 mm) of the first elastic member 64 so that the presence of the second elastic member 65 may be ignored. Further, the second elastic member 65 is formed of a material having a rubber hardness lower than that of the first elastic member 64. For this reason, the second elastic member 65 is compressed by the nip pressure to such an extent that the elasticity thereof is almost eliminated. Thus, the elastic force of the first elastic member 64 herein receives the pressing force from the pressure roll 62. Accordingly, the second elastic member 65 barely has an influence on the formation of the nip portion N, and the nip portion N is formed to have a predetermined nip pressure mainly by the pressure roll 62, which presses the fixing belt 61 while elastically deforming, and the first elastic member 64, which elastically deforms due to the pressing force from the pressure roll 62.

As described above, since the second elastic member 65 is formed to have a larger elastic deformation ratio with respect to the nip pressure at the nip portion N than that of the first elastic member 64, the elastic force of the first elastic member 64 receives almost all of the pressing force from the pressure roll 62 when the pressure roll 62 is arranged in pressure contact with the fixing belt 61; therefore, the second elastic member 65 barely has an influence on the formation of the nip portion N. Thus, the nip pressure at the nip portion N is stably set to a predetermined pressure by both of the pressure roll 62 and the first elastic member 64, which elastically deform.

On the other hand, as shown in FIG. 8B, during the warm-up operation, the pressure roll 62 is arranged apart from the fixing belt 61 by the retract mechanism. In this state, the entire shape of the fixing belt 61 is restored to the original shape (cylindrical shape), and the second elastic member 65 also forms a sponge layer, with a layer thickness of 0.5 mm to 1 mm, extending over the entire circumference of the fixing belt 61. Accordingly, the second elastic member 65 is interposed between the fixing belt 61 and the first elastic member 64 during the warm-up operation.

As described above, during the warm-up operation, the state in which the heat from the fixing belt 61 is unlikely to flow out to the pressure roll 62 at the outer side of the fixing belt 61 is set by separating the pressure roll 62 from the fixing belt 61 by the retract mechanism. Moreover, in the first exemplary embodiment, the state in which the heat from the fixing belt 61 is unlikely to flow out to the first elastic member 64 is also set at the inner side of the fixing belt 61 by interposing the second elastic member 65 between the fixing belt 61 and the first elastic member 64. Thereby, the configuration which further allows the warm-up time for raising the temperature of the fixing belt 61 to the fixable temperature to be reduced is achieved.

In this configuration, the thermal conductivity of the second elastic member 65 is set to be lower than that of the first elastic member 64 by forming the second elastic member 65 by use of an elastic body (sponge layer) obtained by foaming silicone rubber, for example. Accordingly, the configuration in which the second elastic member 65 is interposed between the fixing belt 61 and the first elastic member 64 enhances the effect to prevent the heat from flowing out from the fixing belt 61 to the first elastic member 64 as compared with the configuration in which the first elastic member 64 and the fixing belt 61 are directly in contact with each other.

<Description of Operation Control Relating to Image Formation Processing>

Next, a description will be given of the flow of an image formation operation.

Figure 9:
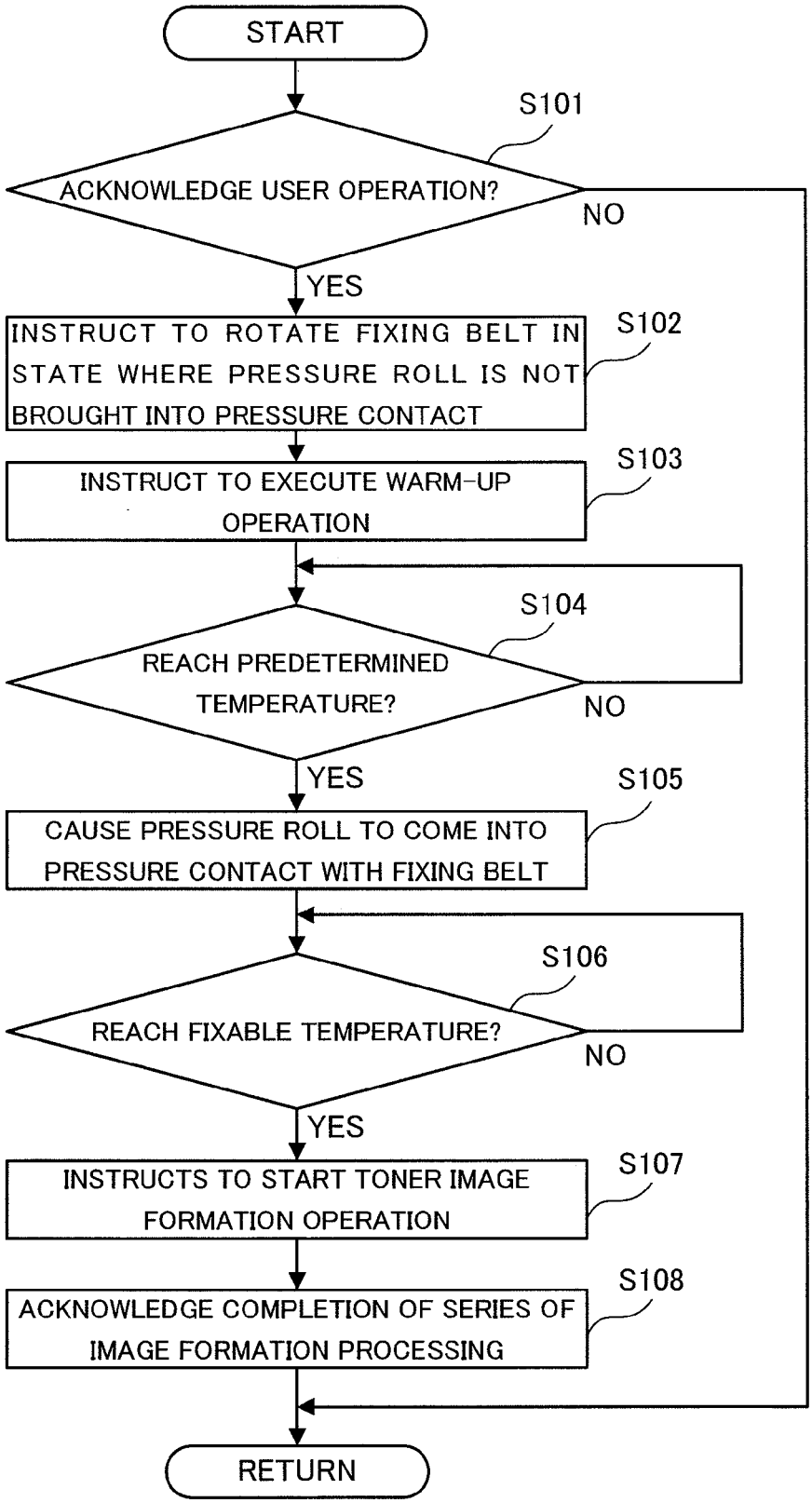
FIG. 9 is a flowchart illustrating an example of the content of the image formation processing performed by the main controller.

FIG. 9 is a flowchart illustrating an example of the content of the image formation processing performed by the main controller 31.

As shown in FIG. 9, the main controller 31 monitors, on the basis of a signal or the like from the image reading unit 33, the UI unit 35 or the communication unit 32, an operation such as placement of a document sheet on the image reading unit 33 to be performed by a user prior to an image formation instruction (hereinafter, referred to as an "user operation") (step 101). Then, when acknowledging the user operation (Yes in step 101), the main controller 31 instructs the fixing device 60 to turn on the drive motor 90 (see FIG. 2 described above) so that the drive motor 90 rotates the fixing belt 61 in a state where the pressure roll 62 is not brought into pressure contact with the fixing belt 61 by the retract mechanism (step 102). Thereafter, the main controller 31 further issues an instruction to execute the warm-up operation (step 103).

At this stage, since the pressure roll 62 is separated from the fixing belt 61, the state where the heat from the fixing belt 61 is unlikely to flow out to the pressure roll 62 is achieved at the outer side of the fixing belt 61. Moreover, the state where the heat from the fixing belt 61 is unlikely to flow out to the first elastic member 64 is also achieved at the inner side of the fixing belt 61 because the second elastic member 65 is interposed between the fixing belt 61 and the first elastic member 64. Thus, the heat is prevented from flowing out from the fixing belt 61 having a small heat capacity, and therefore, the warm-up time to raise the temperature of the fixing belt 61 up to the fixable temperature is reduced. Also, the fixing belt 61 rotates itself by the rotational drive force from the drive motor 90 in this case.

On the other hand, when acknowledging no user operation (No in step 101), the main controller 31 continues to monitor the user operation (step 101).

Then, when the temperature of the fixing belt 61 reaches the predetermined temperature, which is near the fixable temperature but below the fixable temperature, by the warm-up operation (Yes in step 104), the main controller 31 then causes the pressure roll 62 to come into pressure contact with the fixing belt 61 by using the retract mechanism (step 105). Then, when the temperature of the fixing belt 61 with which the pressure roll 62 is in pressure contact reaches the fixable temperature (Yes in step 106), the main controller 31 instructs the image forming part 10 to start a toner image formation operation (step 107).

At this stage, since the pressure roll 62 is arranged in pressure contact with the fixing belt 61, the nip portion N having a predetermined nip pressure is formed between the fixing belt 61 and the pressure roll 62 mainly by the elastic forces of the first elastic member 64 and the pressure roll 62. In addition, the pressure roll 62 drives the fixing belt 61 to rotate.

Then, when acknowledging completion of the series of the image formation processing (step 108), the main controller 31 returns to step 101 again and monitors the user operation.

As described above, the fixing device 60 of the first exemplary embodiment has the fixing belt 61 including the elastic roll that is fitted into the inner side of the fixing belt 61 to extend over the entire width of the fixing belt 61. The elastic roll is integrally formed by the rotation shaft 97, the first elastic member 64, and the second elastic member 65. Here, the second elastic member 65 is formed with a larger elastic deformation ratio with respect to the nip pressure at the nip portion N than that of the first elastic member 64. Moreover, the fixing device 60 of the first exemplary embodiment includes the retract mechanism, which causes the pressure roll 62 to come into contact with or to separate from the fixing belt 61. During the warm-up operation, the pressure roll 62 is kept separated from the fixing belt 61 until the temperature of the fixing belt 61 reaches the predetermined temperature, which is a temperature near the fixable temperature but below the fixable temperature.

Thereby, during the warm-up operation, the state in which the heat from the fixing belt 61 is unlikely to flow out to the pressure roll 62 is set at the outer side of the fixing belt 61. Furthermore, the state in which the heat from the fixing belt 61 is unlikely to flow out to the first elastic member 64 is also set at the inner side of the fixing belt 61 by interposing the second elastic member 65 between the fixing belt 61 and the first elastic member 64. Accordingly, the flow of heat out from the fixing belt 61 having a small heat capacity to the outer side thereof is suppressed, and the warm-up time to raise the temperature of the fixing belt 61 to the fixable temperature is further reduced as compared with the conventional case.

Note that, in the first exemplary embodiment, the second elastic member 65 whose inner circumferential surface is adhered to the outer circumferential surface of the first elastic member 64 and whose outer circumferential surface is adhered to the inner circumferential surface of the fixing belt 61 is arranged between the first elastic member 64 and the fixing belt 61. In this case, in order to further ensure the connection between the first elastic member 64 and the fixing belt 61, the following configuration may be employed. In this configuration, a dot-shaped or linear-shaped partial protrusion is provided on the outer circumferential surface of the first elastic member 64 in a region (non-image region) outside (in the direction of both edge portions) of the width of the sheet P of the maximum size used in the image forming apparatus 1 in the width direction of the fixing belt 61, and then the protrusion of the first elastic member 64 is directly adhered to the fixing belt 61.

[Second Exemplary Embodiment]

In the fixing device 60 of the first exemplary embodiment, the configuration has been described in which the first elastic member 64 and the second elastic member 65 are arranged at the inner side of the fixing belt 61 to extend over the entire with of the fixing belt 61. In the second exemplary embodiment, a configuration in which the second elastic member 65 is arranged at each of both edge regions in the width direction of the fixing belt 61 will be described. Note that, the same reference numerals are used to denote the same components as those in the first exemplary embodiment, and the detailed descriptions thereof are omitted herein.

<Description of Configurations of First Elastic Member and Second Elastic Member>

Figure 10A:
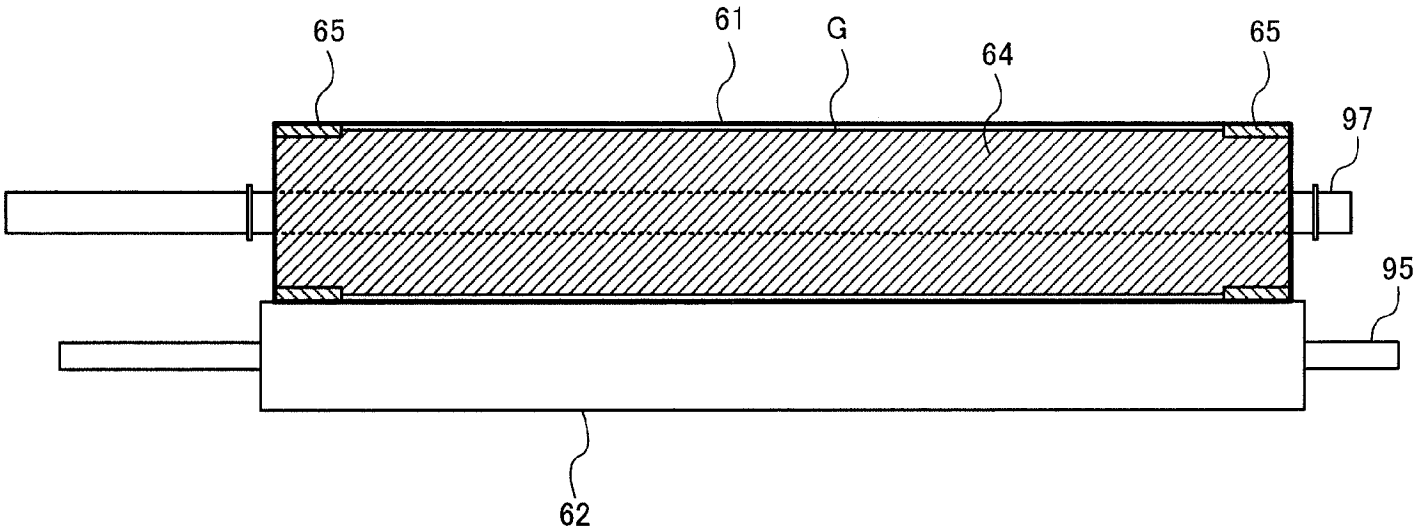
FIGS. 10A to 10C are cross-sectional views illustrating the configurations of the first elastic member and the second elastic member that are arranged at the inner side of the fixing belt.
Figure 10B:
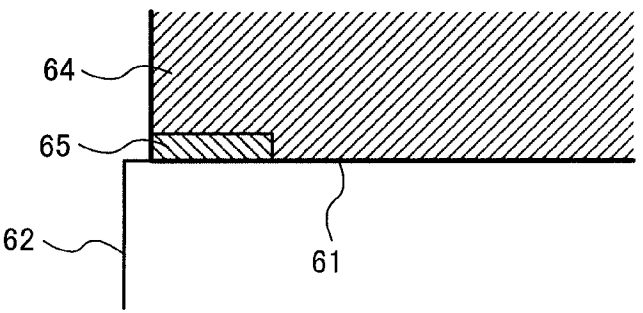
Figure 10C:
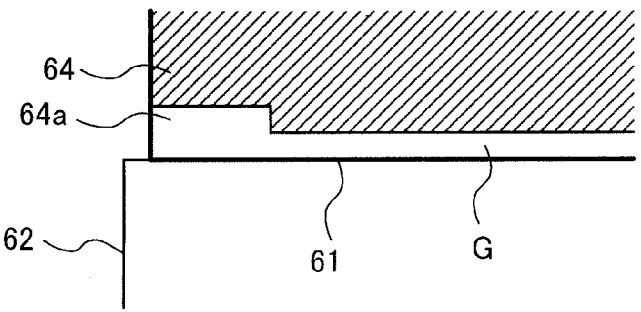

FIGS. 10A to 10C are cross-sectional views illustrating the configurations of the first elastic member 64 and the second elastic member 65 that are arranged at the inner side of the fixing belt 61. FIG. 10A is an overall cross-sectional view of the inner side of the fixing belt 61. FIG. 10B is a cross-sectional view of one of the edge regions at the inner side of the fixing belt 61 in the state where the pressure roll 62 is arranged in pressure contact with the fixing belt 61. FIG. 10C is a cross-sectional view of one of the edge regions at the inner side of the fixing belt 61 for illustrating a notch portion formed at each of the both edge regions of the first elastic member 64.

Firstly, as shown in FIG. 10A, in the fixing device 60 of the second exemplary embodiment, the second elastic member 65 is arranged at each of the both edge regions in the width direction of the fixing belt 61, over a width of 10 mm to 15 mm, for example. In addition, the inner circumferential surface of each of the second elastic members 65 is adhered to the outer circumferential surface of the first elastic member 64 while the outer circumferential surface thereof is adhered to the inner circumferential surface of the fixing belt 61. Then, in a region other than the both edge regions where the second elastic members 65 are arranged, a gap portion G is formed between the fixing belt 61 and the first elastic member 64 by the second elastic members 65 at the both edge regions. The width of the region where the gap portion G is formed is set so as to include the width of the sheet P of the maximum size used in the image forming apparatus 1.

As described above, since the second elastic members 65 are arranged only at the both edge regions in the width direction of the fixing belt 61, the gap portion G is interposed between the fixing belt 61 and the first elastic member 64 in the region other than the both edge regions in the state where the pressure roll 62 is arranged apart from the fixing belt 61 by the retract mechanism. Thereby, the state in which the heat from the fixing belt 61 is unlikely to flow out to the first elastic member 64 is also set at the inner side of the fixing belt 61 as in the case of the configuration of the first exemplary embodiment.

In addition, in the state where the pressure roll 62 is arranged apart from the fixing belt 61, the fixing belt 61 rotates by the above-mentioned drive mechanism via the second elastic members 65 arranged at the both edge regions in the width direction of the fixing belt 61.

Then, when the pressure roll 62 is brought into pressure contact with the fixing belt 61 by the retract mechanism, the first elastic member 64 forms the nip portion N between the fixing belt 61 and the pressure roll 62 while receiving the pressing force from the pressure roll 62 via the fixing belt 61 as shown in FIG. 10B.

In the configuration of the second exemplary embodiment, the second elastic members 65 are arranged only at the both edge regions in the width direction of the fixing belt 61. Then, as shown in FIG. 10C, a notch portion 64*a* as an example of a recessed portion is formed in each of the regions of the first elastic member 64 where the second elastic members 65 are arranged. The notch portions 64*a* are formed in order to prevent, when the pressure roll 62 is brought into pressure contact with the fixing belt 61, generation of a difference in height between each of the both edge regions of the fixing belt 61 where the second elastic members 65 are arranged and the other region where the second elastic members 65 are not arranged. In this manner, the second elastic members 65 are configured to be compressed in the respective notch portions 64*a*, when the pressure roll 62 is brought into pressure contact with the fixing belt 61. Thereby, a configuration in which the above-mentioned difference in height is unlikely to be generated is employed. Thus, the occurrence of unevenness of the pressure at the nip portion N (nip pressure) in the width direction is suppressed.

Here, although, in the second exemplary embodiment, the second elastic members 65 are arranged respectively in the both edge regions on the fixing belt 61 in the width direction, a configuration may be employed in which the second elastic members 65 are respectively arranged at positions at both sides of the center portion of the fixing belt 61 in the width direction (for example, positions symmetrical with respect to the center in the width direction). With this configuration, the gap portion G is formed between the fixing belt 61 and the first elastic member 64 as well as in the case where the second elastic members 65 are respectively arranged at the both edge regions in the width direction.

In this manner, the fixing device 60 of the first and second exemplary embodiments described above has the fixing belt 61 including the elastic roll that is fitted into the inner side of the fixing belt 61 to extend over the entire width of the fixing belt 61 or at a part thereof. The elastic roll is integrally formed by the rotation shaft 97, the first elastic member 64, and the second elastic member 65. Here, the second elastic member 65 is formed with a larger elastic deformation ratio with respect to the nip pressure at the nip portion N than that of the first elastic member 64. Moreover, the fixing device 60 of the first and second exemplary embodiments includes the retract mechanism, which causes the pressure roll 62 to come into contact with or to separate from the fixing belt 61. During the warm-up operation, the pressure roll 62 is kept separated from the fixing belt 61 until the temperature of the fixing belt 61 reaches the predetermined temperature, which is a temperature near the fixable temperature but below the fixable temperature.

Thereby, during the warm-up operation, the state in which the heat from the fixing belt 61 is unlikely to flow out to the pressure roll 62 is set at the outer side of the fixing belt 61. Furthermore, the state in which the heat from the fixing belt 61 is unlikely to flow out to the first elastic member 64 is also set at the inner side of the fixing belt 61 by interposing the second elastic member 65 between the fixing belt 61 and the first elastic member 64. Accordingly, the flow of heat out from the fixing belt 61 having a small heat capacity to the outer side thereof is suppressed, and the warm-up time to raise the temperature of the fixing belt 61 to the fixable temperature is further reduced as compared with the conventional case.

[Third Exemplary Embodiment]

In the fixing device 60 of the first and second exemplary embodiments, the configuration has been described in which the first elastic member 64 and the second elastic member 65 are arranged at the inner side of the fixing belt 61 to extend over the entire with of the fixing belt 61 or at a part thereof. In the third exemplary embodiment, a description will be given of a configuration in which an elastic member 66 is arranged at the inner side of the fixing belt 61 to extend over the entire with of the fixing belt 61, and the fixing belt 61 and the elastic member 66 are bonded so that the gap portion G is formed therebetween. Note that, the same reference numerals are used to denote the same components as those in the first exemplary embodiment, and the detailed descriptions thereof are omitted herein.

<Description of Overall Configuration of Fixing Device>

Next, a description will be given of the fixing device 60 in the third exemplary embodiment.

Figure 11:
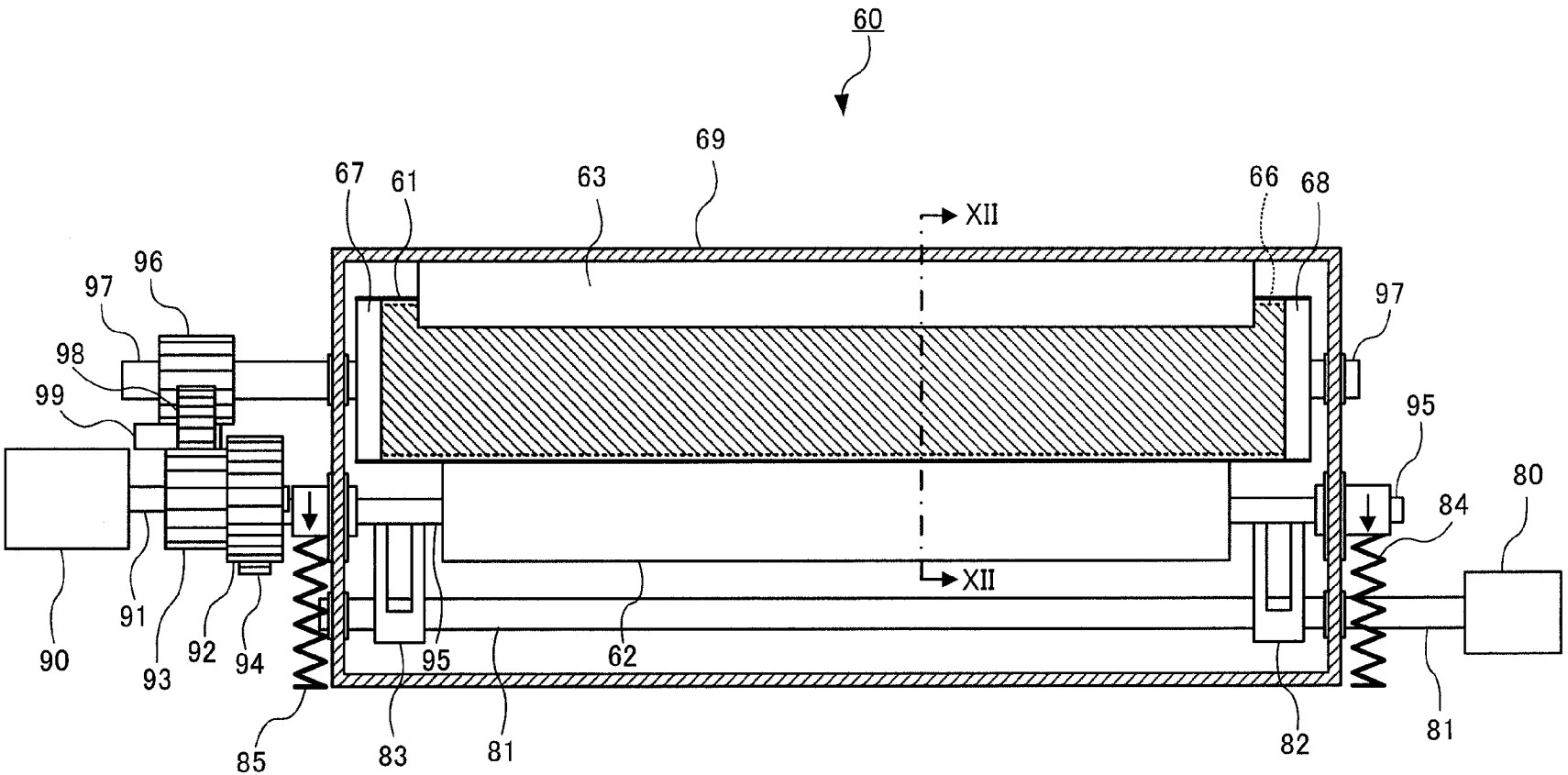
FIG. 11 is a front view illustrating a configuration of the fixing device.
Figure 12:
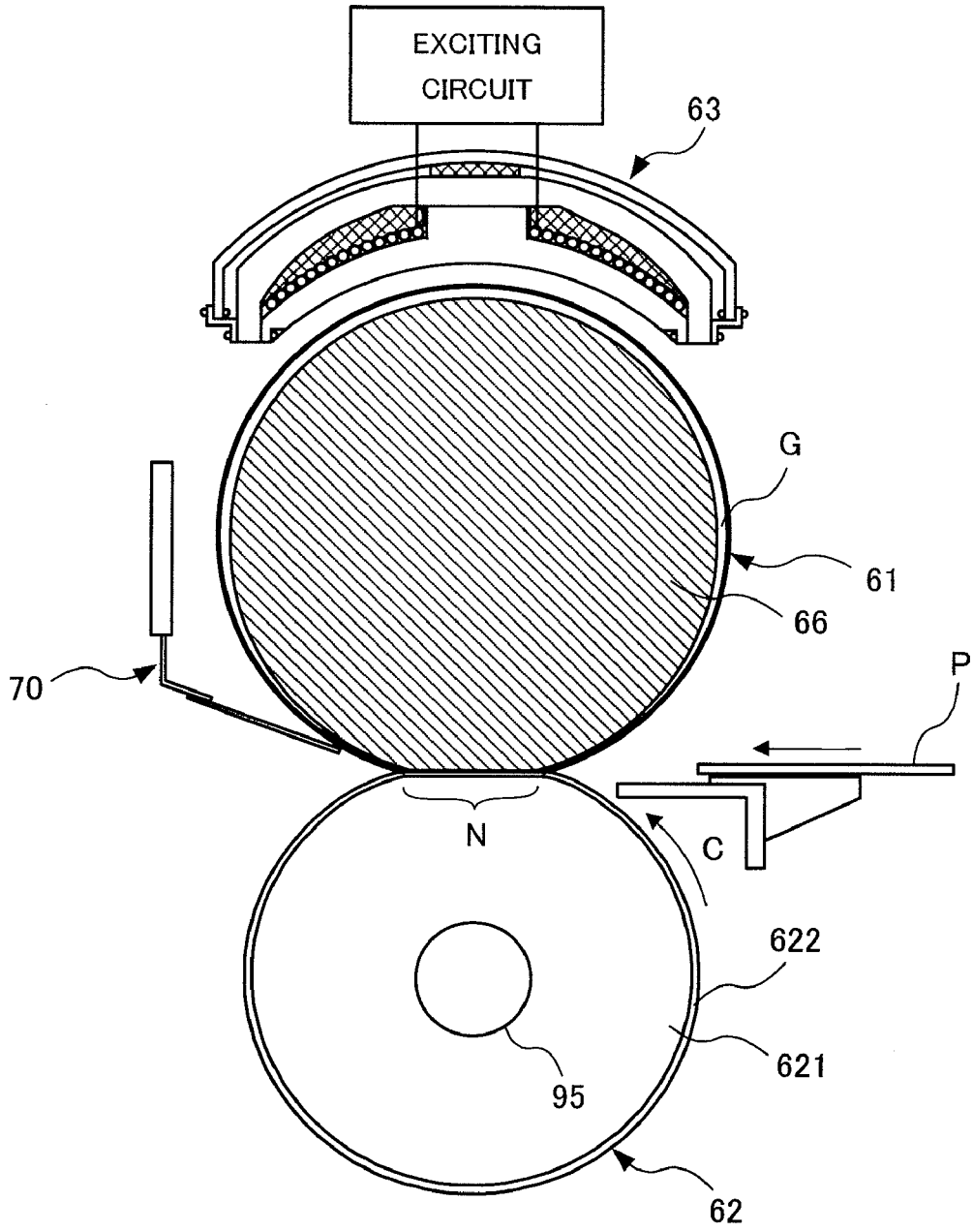
FIG. 12 is a cross sectional view illustrating the configuration of the fixing device, taken along the line XII-XII in FIG. 11.

FIGS. 11 and 12 are diagrams illustrating a configuration of the fixing device 60 of the third exemplary embodiment. FIG. 11 is a front view of the fixing device 60 seen from a side from which the sheet P is transported, and FIG. 12 is a cross sectional view of the fixing device 60, taken along the line XII-XII in FIG. 11.

As shown in FIGS. 11 and 12, inside of the support body 69 (see FIG. 11), the fixing device 60 includes: the induction heating (IH) heater 63 as an example of a magnetic field generating member that generates an AC (alternate-current) magnetic field; the fixing belt 61 as an example of the heating member that is heated through electromagnetic induction by the IH heater 63, and thereby heats a toner image; the elastic member 66 as an example of the first elastic member (see FIG. 12) that is arranged at the inner side of the fixing belt 61; the pressure roll 62 as an example of the pressing member that is arranged so as to face the fixing belt 61; and the peeling assisting member 70 (see FIG. 12) that assists peeling of the sheet P from the fixing belt 61.

<Description of Elastic Member>

In the fixing device 60 of the third exemplary embodiment, the elastic member 66 is arranged at the inner side of the fixing belt 61 to extend over the entire width of the fixing belt 61. The elastic member 66 is formed of a cylindrical roll that is formed of an elastic body of rubber, elastomer or the like (for example, silicone rubber) having a rubber hardness of 15° to 45° (JIS-A), for example, and that has an outer diameter of 28 mm.

The elastic member 66 is arranged in such a way that the outer circumferential surface thereof is not contact with the inner circumferential surface of the fixing belt 61 except for the nip portion N. Here, the nip portion N is the region where the pressure roll 62 is in pressure contact with the fixing belt 61 (in contact with the fixing belt 61 while pressing it). Thereby, the elastic member 66 forms the gap portion G, as an example of a gap, between the outer circumferential surface thereof and the inner circumferential surface of the fixing belt 61 except for a case in which the nip portion N is formed.

In addition, both edges portions of the elastic member 66 are supported by end cap members 67 and 68, as well as both edges portions of the fixing belt 61.

<Description of Method for Supporting Fixing Belt and Elastic Member>

On the fixing belt 61 and the elastic member 66 having such a configuration, the end cap members 67 and 68, as an example of a support member, having a cylindrical shape are mounted, as shown in FIG. 11. Thereby, the fixing belt 61 and the elastic member 66 and the end cap members 67 and 68 are adhered to each other, and are fixed (bonded). In this case, as shown in FIG. 12, the end cap members 67 and 68 bond the fixing belt 61 and the elastic member 66 so that the outer circumferential surface of the elastic member 66 is not contact with the inner circumferential surface of the fixing belt 61 and thereby the gap portion G is formed.

The end cap members 67 and 68 are formed of a heat-resistant material having high rigidity, such as heat-resistant resin including heat-resistant glass, polycarbonate, PPS (polyphenylene sulfide) and the like, or heat-resistant resin obtained by blending a glass fiber into these materials, for example.

In addition, at the rotation centers of the end cap members 67 and 68, the rotation shaft 97 is provided toward the respective outer sides thereof (sides opposite to the fixing belt 61). Both ends of the rotation shaft 97 are supported by the support body 69 so as to be rotatable.

Figure 13A:
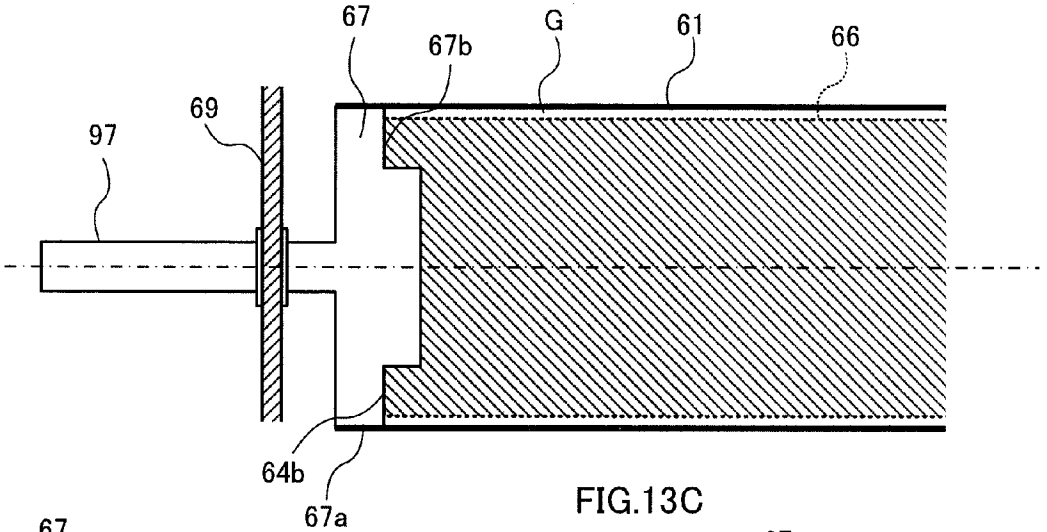
FIGS. 13A to 13C are diagrams illustrating a bond portion of the fixing belt and the elastic member with the end cap member.
Figure 13B:
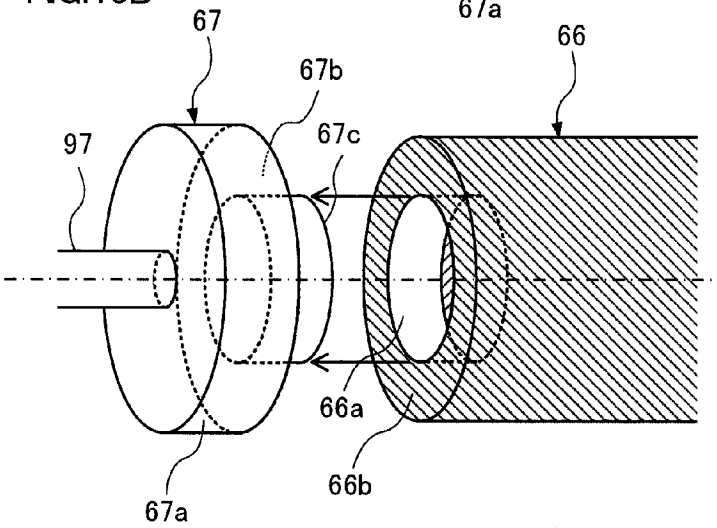
Figure 13C:
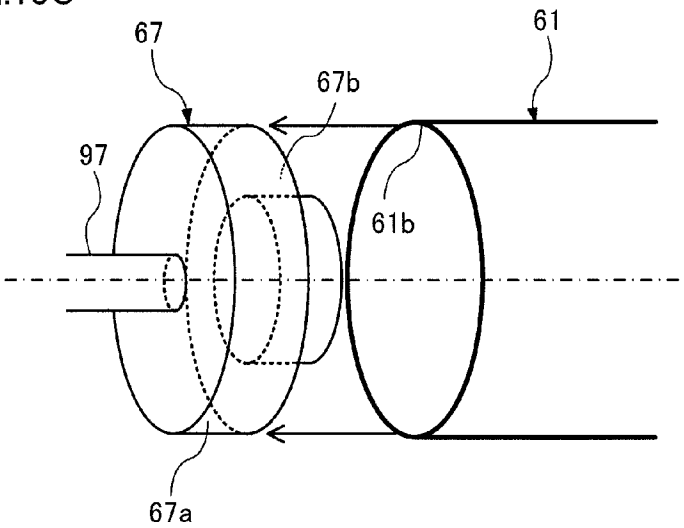

FIGS. 13A to 13C are diagrams illustrating a bond portion of the fixing belt 61 and the elastic member 66 with the end cap member 67 (68). FIG. 13A is a cross-sectional view of the bond portion of the fixing belt 61 and the elastic member 66 with the end cap member 67. FIG. 13B is a perspective view showing how the elastic member 66 is bonded to the end cap member 67. FIG. 13C is a perspective view showing how the fixing belt 61 is bonded to the end cap member 67. Although FIGS. 13A to 13C exemplify to the bonding to the end cap member 67, the bonding to the end cap member 68 is also formed in the same manner.

Firstly, as shown in FIG. 13A, the end cap member 67 has an outer circumferential side surface 67*a* bonded to an inner circumferential surface 61*b* (see FIG. 13C) of the fixing belt 61, and a bottom surface (inner side bottom surface) 67*b* on the fixing belt 61 bonded to a bottom surface 66*b* of the elastic member 66. More specifically, as shown in FIG. 13B, a cylindrical protrusion 67*c* having, as the center axis thereof, the rotation center (denoted by a dashed-dotted line in FIGS. 13A to 13C) of the end cap member 67 is formed on the inner side bottom surface 67*b* of the end cap member 67. In addition, a circular recessed portion 66*a* having, as the center axis thereof, the rotation center (denoted by the dashed-dotted line in FIGS. 13A to 13C) of the elastic member 66 is formed on the bottom surface 66*b* of the elastic member 66, which faces the inner side bottom surface 67*b* of the end cap member 67. Then, the circular recessed portion 66*a* of the elastic member 66 is fitted with the cylindrical protrusion 67*c* of the end cap member 67. Thereby, the elastic member 66 is bonded to the end cap member 67 while sharing the rotation center (denoted by the dashed-dotted line in FIGS. 13A to 13C) with the end cap member 67.

The elastic member 66 herein is stably supported because the elastic member 66 is bonded to the end cap members 67 and 68 formed of heat-resistant resin having high rigidity. Thus, the nip pressure at the nip portion N is kept at a constant value in a stable manner.

In addition, as shown in FIG. 13C, the inner circumferential surface 61*b* of the fixing belt 61 is bonded to the outer circumferential side surface 67*a* of the end cap member 67. In this case, the diameter of the inner side bottom surface 67*b* of the end cap member 67 is formed so as to coincide with the diameter of the fixing belt 61 when the fixing belt 61 is in the original shape (cylindrical shape). Accordingly, the fixing belt 61 is closely bonded to the end cap member 67 without bending at the bond portion to the end cap member 67.

In addition, as shown in FIG. 11 described above, the drive transmission gear 96 is fixed to the rotation shaft 97 of the end cap member 67. Then, in the state where the pressure roll 62 is brought into pressure contact with the fixing belt 61 (in contact with the fixing belt 61 while pressing it) by the contacting/separating mechanism, the fixing belt 61 is driven to rotate by the frictional force from the pressure roll 62 while no rotational drive force from the drive motor 90 is transmitted to the drive transmission gear 96. Meanwhile, in the state where the fixing belt 61 is separated from the pressure roll 62, the rotational drive force from the drive motor 90 is transmitted to the drive transmission gear 96, and the fixing belt 61 rotates without any frictional force via the end cap member 67.

Note that, the mechanism to drive the fixing belt 61 and the pressure roll 62 and the contacting/separating mechanism (retract mechanism) as an example of the contacting/separating unit that causes the pressure roll 62 to come into contact with and to separate from the fixing belt 61 are similar to those in the first and second exemplary embodiments (see FIGS. 5A to 6B, described above).

<Description of Function of Elastic Member>

Next, a description will be given of a function of the elastic member 66 arranged at the inner side of the fixing belt 61.

As described above, the fixing device 60 of the third exemplary embodiment includes the retract mechanism, which brings the pressure roll 62 to be in contact with or to separate from the fixing belt 61. When the operation to raise the temperature of the fixing belt 61 up to the fixable temperature by the IH heater 63 (warm-up operation) is performed before the fixing operation is started, the pressure roll 62 is set at the position where the pressure roll 62 is separated from the fixing belt 61 by the retract mechanism. In this manner, the fixing belt 61 is efficiently heated by setting up a situation where heat leakage from the fixing belt 61 having a small heat capacity to the pressure roll 62 is unlikely to occur. Then, the amount of time required for raising the temperature of the fixing belt 61 up to the fixable temperature (hereinafter, referred to as "warm-up time") is reduced. Here, during the warm-up operation, the fixing belt 61 is rotationally driven directly by the rotational drive force from the drive motor 90 by the action of the above-mentioned drive mechanism.

Meanwhile, the pressure roll 62 is brought into pressure contact with the fixing belt 61 by the retract mechanism at timing when the temperature of the fixing belt 61 reaches a predetermined temperature by the warm-up operation. The predetermined temperature herein is a temperature near the fixable temperature but below the fixable temperature. At this time, the fixing belt 61 is driven and rotated by the pressure roll 62 rotating due to the rotational drive force from the drive motor 90 by the above-mentioned drive mechanism. Accordingly, the heat flows out from the fixing belt 61 to the pressure roll 62. In this state, however, the temperature of the fixing belt 61 has already reached near the fixable temperature. Thus, the heating of the fixing belt 61 up to the fixable temperature by the electromagnetic induction heating by the IH heater 63 continues while the fixing belt 61 transfers the heat to the pressure roll 62. Then, the temperature of the fixing belt 61 eventually reaches the fixable temperature. When the temperature of the fixing belt 61 reaches the fixable temperature, the sheet P is transported to the nip portion N, and the fixing operation is started.

Here, as described above, in the fixing device 60 of the third exemplary embodiment, the elastic member 66 is arranged at the inner side of the fixing belt 61 so as to extend over the entire width of the fixing belt 61. During the fixing operation, the pressure roll 62 is arranged in pressure contact with the fixing belt 61 by the retract mechanism, so that the fixing belt 61 forms the nip portion N with the pressure roll 62 by the elastic forces of both of the elastic member 66 and the pressure roll 62. On the other hand, during the warm-up operation, the pressure roll 62 is arranged apart from the fixing belt 61 by the retract mechanism, so that the shape of the entire fixing belt 61 is restored to the original shape. Thereby, the configuration in which the gap portion G is interposed between the fixing belt 61 and the elastic member 66 is formed.

Figure 14A:
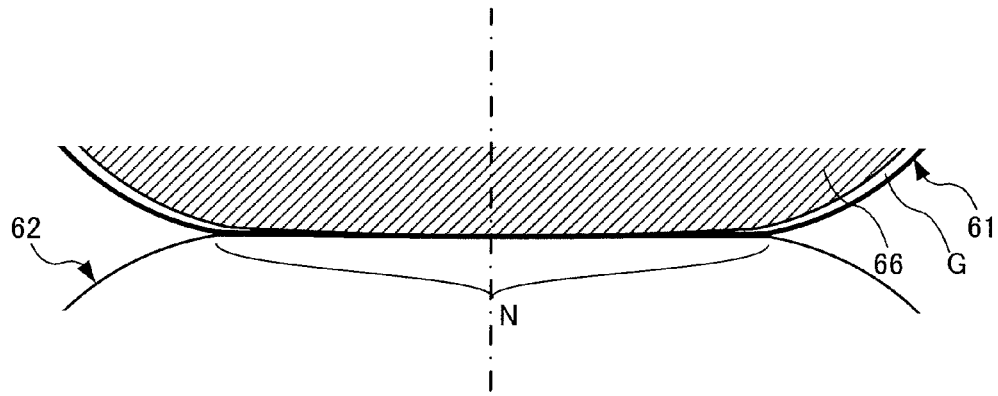
FIGS. 14A and 14B are diagrams showing the states of the fixing belt in the region in the vicinity of the nip portion.
Figure 14B:
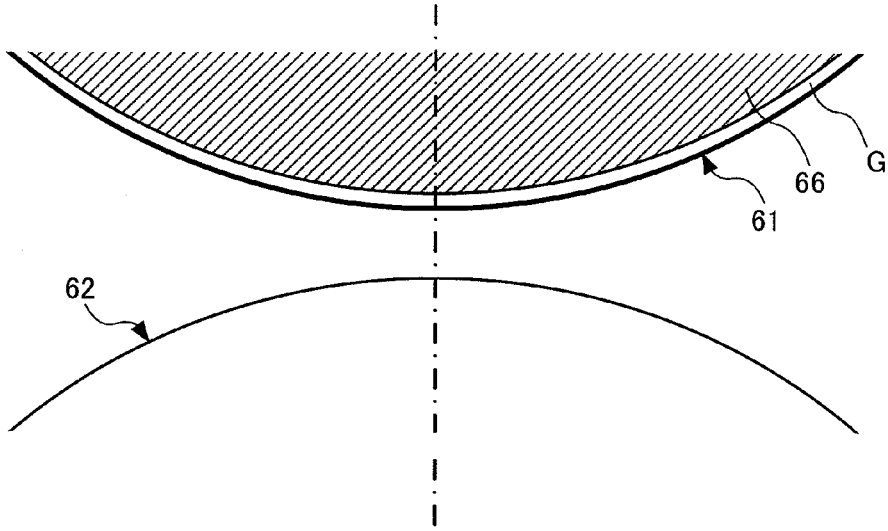

Next, FIGS. 14A and 14B are diagrams showing the states of the fixing belt 61 in the region in the vicinity of the nip portion N. FIG. 14A shows the state where the pressure roll 62 is in pressure contact with the fixing belt 61, while FIG. 14B shows the state where the pressure roll 62 is separated from the fixing belt 61.

As shown in FIG. 14A, during the fixing operation, the pressure roll 62 is arranged in pressure contact with the fixing belt 61 by the retract mechanism. In this state, at the nip portion N, the fixing belt 61 is pressed against the elastic member 66, so that the inner circumferential surface of the fixing belt 61 and the outer circumferential surface of the elastic member 66 are brought into close contact with each other. In addition, the nip portion N having a predetermined nip pressure is formed by the pressure roll 62, which presses the fixing belt 61 while elastically deforming, and by the elastic member 66, which is elastically deformed by the pressing force from the pressure roll 62.

As described above, when the pressure roll 62 is arranged in pressure contact with the fixing belt 61, the inner circumferential surface of the fixing belt 61 is pressed against the outer circumferential surface of the elastic member 66. Thereby, the elastic member 66 is elastically deformed by receiving the pressing force from the pressure roll 62, and thus the nip portion N is formed (see FIG. 14A). Thus, the nip pressure at the nip portion N is stably set to a predetermined pressure by both of the pressure roll 62 and the elastic member 66, which elastically deform.

On the other hand, as shown in FIG. 14B, during the warm-up operation, the pressure roll 62 is arranged apart from the fixing belt 61 by the retract mechanism. In this state, the configuration is formed in which the gap portion G is interposed between the fixing belt 61 and the elastic member 66 so as to extend over the entire circumference of the fixing belt 61.

As described above, during the warm-up operation, the state in which the heat from the fixing belt 61 is unlikely to flow out to the pressure roll 62 at the outer side of the fixing belt 61 is set by separating the pressure roll 62 from the fixing belt 61 by the retract mechanism. Moreover, in the third exemplary embodiment, the state in which the heat from the fixing belt 61 is unlikely to flow out to the elastic member 66 is also set at the inner side of the fixing belt 61 by interposing the gap portion G between the fixing belt 61 and the elastic member 66. Thereby, the configuration which further allows the warm-up time for raising the temperature of the fixing belt 61 to the fixable temperature to be reduced is achieved.

As described above, in the fixing device 60 of the third exemplary embodiment, the elastic member 66 is arranged at the inner side of the fixing belt 61 to extend over the entire width of the fixing belt 61. In addition, the fixing belt 61 and the elastic member 66 are bonded to each other with the end cap members 67 and 68 so as to form the gap portion G therebetween. Moreover, the fixing device 60 of the third exemplary embodiment includes the retract mechanism, which causes the pressure roll 62 to come into contact with or to separate from the fixing belt 61. During the warm-up operation, the pressure roll 62 is kept separated from the fixing belt 61 until the temperature of the fixing belt 61 reaches the predetermined temperature, which is a temperature near the fixable temperature but below the fixable temperature.

Thereby, during the warm-up operation, the state in which the heat from the fixing belt 61 is unlikely to flow out to the pressure roll 62 is set at the outer side of the fixing belt 61. Furthermore, the state in which the heat from the fixing belt 61 is unlikely to flow out to the elastic member 66 is also set at the inner side of the fixing belt 61 by interposing the gap portion G between the fixing belt 61 and the elastic member 66. Accordingly, the flow of heat out from the fixing belt 61 having a small heat capacity to the outer side thereof is suppressed, and the warm-up time to raise the temperature of the fixing belt 61 to the fixable temperature is further reduced as compared with the conventional case.

[Fourth Exemplary Embodiment]

In the fixing device 60 of the third exemplary embodiment, the configuration has been described in which the fixing belt 61 and the elastic member 66 are bonded to each other so as to form the gap portion G therebetween by the end cap members 67 and 68 each formed of heat-resistant resin having high rigidity. In the fourth exemplary embodiment, a description will be given of a configuration in which the fixing belt 61 and the elastic member 66 are bonded to each other so as to form the gap portion G therebetween by the end cap members 67 and 68 each formed of heat-resistant resin having low rigidity. Here, the same reference numerals are used to denote the same components as those in the third exemplary embodiment, and the detailed descriptions thereof are omitted herein.

<Description of Bond Portion of Fixing Belt and Elastic Member with End Cap Members>

Figure 15A:
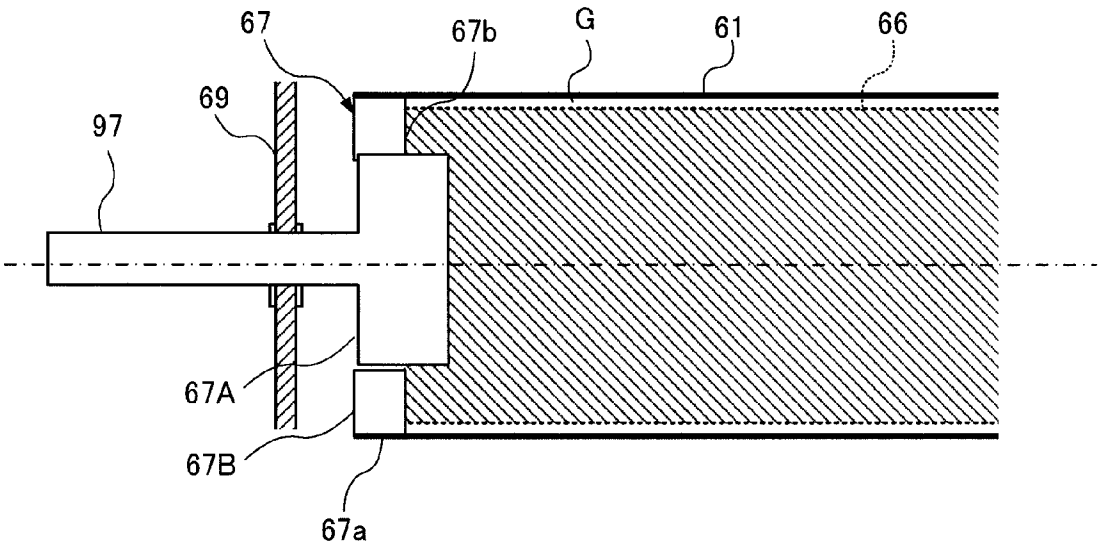
FIGS. 15A to 15C are diagrams illustrating a bond portion of the fixing belt and the elastic member with the end cap member.
Figure 15B:
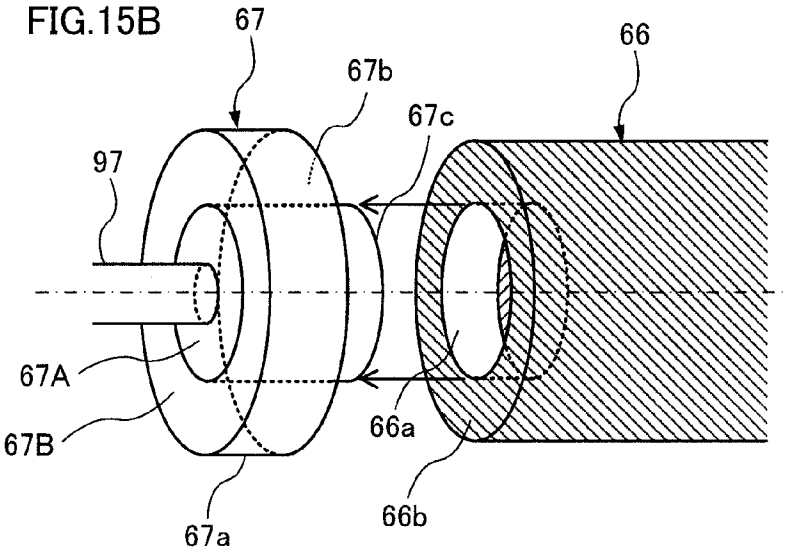
Figure 15C:
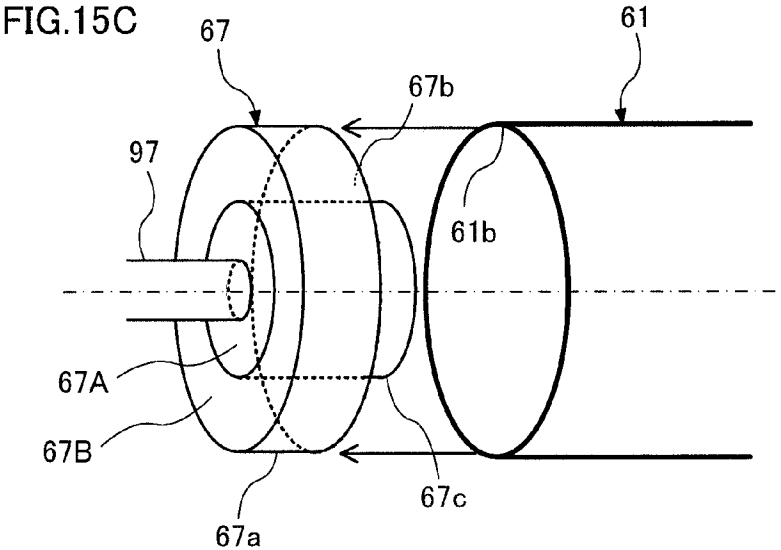

FIGS. 15A to 15C are diagrams illustrating a bond portion of the fixing belt 61 and the elastic member 66 with the end cap member 67 (68) of the fourth exemplary embodiment. FIG. 15A is a cross-sectional view of the bond portion of the fixing belt 61 and the elastic member 66 with the end cap member 67. FIG. 15B is a perspective view showing how the elastic member 66 is bonded to the end cap member 67. FIG. 15C is a perspective view showing how the fixing belt 61 is bonded to the end cap member 67. Although FIGS. 15A to 15C exemplify to the bonding to the end cap member 67, the bonding to the end cap member 68 is also formed in the same manner.

Firstly, as shown in FIG. 15A, the end cap member 67 (end cap member 68) of the fourth exemplary embodiment is formed of a main body portion 67A and a sponge layer portion 67B. Here, the main body portion 67A is made of heat-resistant resin having high rigidity and integrally formed with the rotation shaft 97. The sponge layer portion 67B is formed into a cylindrical shape, serves as an example of an elastic layer portion having a higher elastic deformation ratio than that of the main body portion 67A and is fitted onto the outer circumferential side surface 67*a* of the main body portion 67A. For example, the sponge layer portion 67B is formed of an elastic body having a rubber hardness of 15° to 35° (JIS-A) obtained by foaming silicone rubber. Since the main body portion 67A is formed of heat-resistant resin having high rigidity, the rotational drive force from the drive motor 90 is efficiently and stably transmitted. Note that, the "elastic deformation ratio" herein refers to the amount of elastic deformation per unit volume when a pressing force acts thereon.

Then, the inner circumferential surface 61*b* (see FIG. 15C) of the fixing belt 61 is bonded to the outer circumferential side surface 67*a* of the sponge layer portion 67B. In addition, the bottom surface 66*b* (see FIG. 15B) of the elastic member 66 is bonded to the main body portion 67A.

More specifically, as shown in FIG. 15B, the main body portion 67A of the end cap member 67 forms the cylindrical protrusion 67*c* having, as the center axis thereof, the rotation center (denoted by a dashed-dotted line in FIGS. 15A to 15C) of the end cap member 67 on the fixing belt 61. In addition, the circular recessed portion 66*a* having, as the center axis thereof, the rotation center (denoted by the dashed-dotted line in FIGS. 15A to 15C) of the elastic member 66 is formed on the inner side bottom surface 66*b* of the elastic member 66, which faces the main body portion 67A of the end cap member 67. Then, the circular recessed portion 66*a* of the elastic member 66 is fitted with the main body portion 67A (cylindrical protrusion 67*c*) of the end cap member 67. Thereby, the elastic member 66 is bonded to the end cap member 67 while sharing the rotation center (denoted by the dashed-dotted line in FIGS. 15A to 15C) with the end cap member 67. In this case, the inner side bottom surface 67*b* of the sponge layer portion 67B and the bottom surface 66*b* of the elastic member 66 are set to be in contact with each other or to have a slight gap therebetween. Specifically, the bottom surface 66*b* of the elastic member 66 is arranged so as not to be in pressure contact with the inner side bottom surface 67*b* of the sponge layer portion 67B in order to prevent the sponge layer portion 67B from deforming due to the pressure from the elastic member 66.

The elastic member 66 herein is stably supported because the elastic member 66 is bonded to the main body portion 67A formed of heat-resistant resin having high rigidity. Thus, the nip pressure at the nip portion N is kept at a constant value in a stable manner.

In addition, as shown in FIG. 15C, the inner circumferential surface 61*b* of the fixing belt 61 is bonded to the outer circumferential side surface 67*a* of the sponge layer portion 67B of the end cap member 67. In this case, the outer diameter of the sponge layer portion 67B is formed so as to coincide with or to be slightly larger than the diameter of the fixing belt 61 when the fixing belt 61 is in the original shape (cylindrical shape). Accordingly, the fixing belt 61 is closely bonded to the end cap member 67.

Then, in the state where the pressure roll 62 is brought into pressure contact with the fixing belt 61 by the above-mentioned retract mechanism, the rotational drive force from the drive motor 90 is not transmitted to the drive transmission gear 96, and the fixing belt 61 is driven and rotated by the frictional force from the pressure roll 62. On the other hand, in the state where the pressure roll 62 is separated from the fixing belt 61, the rotational drive force from the drive motor 90 is transmitted to the drive transmission gear 96. Thereby, the rotational drive force is transmitted from the drive transmission gear 96 to the sponge layer portion 67B via the rotation shaft 97 of the end cap member 67 and further via the main body portion 67A of the end cap member 67, and the fixing belt 61 bonded to the sponge layer portion 67B rotates by itself.

In this configuration, in the state where the pressure roll 62 is brought into pressure contact with the fixing belt 61 by the retract mechanism, the fixing belt 61 is pressed against the elastic member 66, so that the inner circumferential surface of the fixing belt 61 and the outer circumferential surface of the elastic member 66 are brought into close contact with each other. In addition, the nip portion N having a predetermined nip pressure is formed by the pressure roll 62, which presses the fixing belt 61 while elastically deforming, and by the elastic member 66, which is elastically deformed by the pressing force from the pressure roll 62.

At this time, as the fixing belt 61 deforms along the outer circumferential surface of the elastic member 66 while being in close contact with the elastic member 66 elastically deformed, the sponge layer portion 67B of the end cap member 67 is compressed and deformed in accordance with the deformation of the fixing belt 61.

<Description of State in which Sponge Layer Portion of End Cap Member is Compressed and Deformed>

Figure 16:
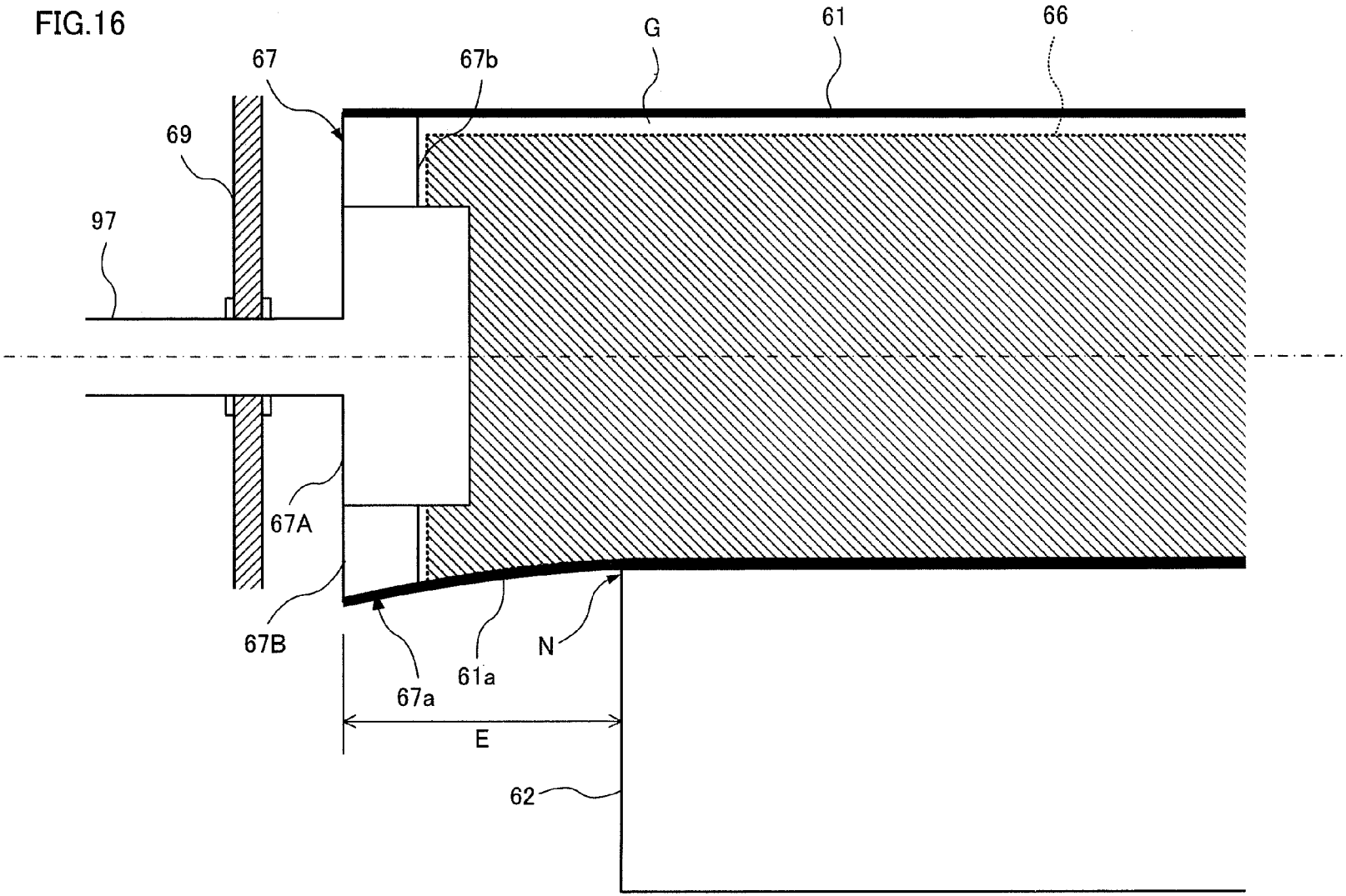
FIG. 16 is a diagram showing the state in which the sponge layer portion of the end cap member is compressed and deformed in accordance with the deformation of the fixing belt.

Next, FIG. 16 is a diagram showing the state in which the sponge layer portion 67B of the end cap member 67 is compressed and deformed in accordance with the deformation of the fixing belt 61.

As shown in FIG. 16, when pressed at the nip portion N by the pressure roll 62, the fixing belt 61 is compressed and deformed along the outer circumferential surface of the elastic member 66 which is elastically deformed due to the pressing force from the pressure roll 62. Specifically, the fixing belt 61 curves along the outer circumferential surface of the elastic member 66 at a portion 61*a* located in an end region E. The end region E extends from a corresponding one of the both edge portions of the fixing belt 61 to the region where the pressure roll 62 presses the fixing belt 61. In this case, the sponge layer portion 67B of the end cap member 67 is formed with low rigidity so as to be compressed and deformed in accordance with the curving of the fixing belt 61. For this reason, the sponge layer portion 67B is compressed and deformed in accordance with the curving of the fixing belt 61. Thereby, the portion 61*a* of each of the both edge portions of the fixing belt 61 gradually deforms while drawing a smooth curve from the edge portion thereof toward the region where the pressure roll 62 presses the fixing belt 61. Thus, the addition of a large force partially to the fixing belt 61 is suppressed, so that damage, such as buckling and bent, on the fixing belt 61 is unlikely to occur.

In addition, in the state where the pressure roll 62 is arranged apart from the fixing belt 61 by the retract mechanism, the gap portion G is interposed between the fixing belt 61 and the elastic member 66 by the end cap member 67 having the configuration in which the sponge layer portion 67B is formed on the outer circumferential surface thereof, as in the case of the third exemplary embodiment. Thereby, the state in which the flow of heat from the fixing belt 61 to the elastic member 66 is unlikely to occur is set at the inner side of the fixing belt 61.

Moreover, in the state where the pressure roll 62 is arranged apart from the fixing belt 61, the fixing belt 61 rotates by the above-mentioned drive mechanism via the end cap member 67 having the configuration in which the sponge layer portion 67B is formed on the outer circumferential portion thereof.

In this manner, in the fixing device 60 of the third and fourth exemplary embodiments described above, the elastic member 66 is arranged at the inner side of the fixing belt 61 to extend over the entire width of the fixing belt 61. In addition, the fixing belt 61 and the elastic member 66 are bonded to each other with the end cap members 67 and 68 so as to form the gap portion G therebetween. Moreover, the fixing device 60 of the fourth exemplary embodiment includes the retract mechanism, which causes the pressure roll 62 to come into contact with or to separate from the fixing belt 61. During the warm-up operation, the pressure roll 62 is kept separated from the fixing belt 61 until the temperature of the fixing belt 61 reaches the predetermined temperature, which is a temperature near the fixable temperature but below the fixable temperature.

Thereby, during the warm-up operation, the state in which the heat from the fixing belt 61 is unlikely to flow out to the pressure roll 62 is set at the outer side of the fixing belt 61. Furthermore, the state in which the heat from the fixing belt 61 is unlikely to flow out to the elastic member 66 is also set at the inner side of the fixing belt 61 by interposing the gap portion G between the fixing belt 61 and the elastic member 66. Accordingly, the flow of heat out from the fixing belt 61 having a small heat capacity to the outer side thereof is suppressed, and the warm-up time to raise the temperature of the fixing belt 61 to the fixable temperature is further reduced as compared with the conventional case.

Note that the present invention may be applied not only to a heating device (the fixing device 60) to be installed in an image forming apparatus such as a copier and a printer using an electrophotographic method, as has been described above, but also to a heating device that is to be installed in an image forming apparatus such as a copier and a printer using an ink-jet method, for example, and that dries a non-dried ink image held on a recording paper (sheet), for example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member that includes a heat generation layer generating heat through electromagnetic induction, and that heats a recording medium by the heat generation layer heated through electromagnetic induction;

a pressure member that is configured to come into contact with and to separate from the heating member, and that forms a nip portion between the pressure member and the heating member by coming into contact with the heating member, the nip portion being a portion through which the recording medium passes;

a first elastic member that is arranged at an inner side of the heating member, and that is elastically deformed at the nip portion by a pressing force from the pressure member;

a second elastic member being arranged between an outer circumferential surface of the first elastic member and an inner circumferential surface of the heating member while being fixed to both of the first elastic member and the heating member, and having a larger elastic deformation ratio at the nip portion than the first elastic member; and a support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member, wherein the heating device comprises the second elastic member, and the second elastic member has a lower thermal conductivity than the first elastic member.

2. The heating device according to claim 1, further comprising a contacting/separating unit that causes the pressure member to come into contact with and to separate from the heating member, wherein the contacting/separating unit sets the pressure member at a position where the pressure member is separated from the heating member until the heating member is heated to a predetermined temperature, and the contacting/separating unit sets the pressure member at a position where the pressure member is in contact with the heating member when the heating member is heated to the predetermined temperature.

3. The heating device according to claim 2, wherein the heating device comprises the second elastic member, and the second elastic member is arranged on each of both sides of the heating member in a width direction of the heating member with respect to a center of the heating member in the width direction.

4. The heating device according to claim 3, wherein the first elastic member has a recessed portion formed in a region where the second elastic member is arranged.

5. A heating device comprising:

a heating member that includes a heat generation layer generating heat through electromagnetic induction, and that heats a recording medium by the heat generation layer heated through electromagnetic induction;

a pressure member that is configured to come into contact with and to separate from the heating member, and that forms a nip portion between the pressure member and the heating member by coming into contact with the heating member, the nip portion being a portion through which the recording medium passes;

a first elastic member that is arranged at an inner side of the heating member, and that is elastically deformed at the nip portion by a pressing force from the pressure member;

a second elastic member being arranged between an outer circumferential surface of the first elastic member and an inner circumferential surface of the heating member while being fixed to both of the first elastic member and the heating member, and having a larger elastic deformation ratio at the nip portion than the first elastic member, and a support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member, wherein the heating device comprises the support member, the support member is formed of:

a main body portion to which the rotational drive force is transmitted; and an elastic layer portion that is arranged between the main body portion and the heating member and has a higher elastic deformation ratio than the main body portion, and the support member causes the heating member to rotate via the main body portion and the elastic layer portion when the contacting/separating unit sets the pressure member at the position where the pressure member is separated from the heating member.

6. The heating device according to claim 5, further comprising a contacting/separating unit that causes the pressure member to come into contact with and to separate from the heating member, wherein the contacting/separating unit sets the pressure member at a position where the pressure member is separated from the heating member until the heating member is heated to a predetermined temperature, and the contacting/separating unit sets the pressure member at a position where the pressure member presses the first elastic member via the heating member when the heating member is heated to the predetermined temperature.

7. The heating device according to claim 6, wherein the heating device comprises the support member, and the support member is arranged at each of both edge portions of the heating member, and is configured so that a portion of the support member supporting the heating member deforms in accordance with deformation of the heating member when the pressure member is set at the position where the pressure member presses the first elastic member via the heating member.

8. The heating device according to claim 6, wherein the heating device comprises the support member, the support member is formed of:

a main body portion to which the rotational drive force is transmitted; and an elastic layer portion that is arranged between the main body portion and the heating member and has a higher elastic deformation ratio than the main body portion, and the support member causes the heating member to rotate via the main body portion and the elastic layer portion when the contacting/separating unit sets the pressure member at the position where the pressure member is separated from the heating member.

9. The heating device according to claim 5, wherein the support member has the main body portion to which the first elastic member is bonded.

10. An image forming apparatus comprising:

an image forming unit that forms an image;

a transfer unit that transfers, onto a recording medium, the image formed by the image forming unit; and a heating unit that heats the recording medium on which the image is transferred, wherein the heating unit includes:

a heating member that includes a heat generation layer generating heat through electromagnetic induction, and that heats the recording medium by the heat generation layer heated through electromagnetic induction;

a pressure member that is configured to come into contact with and to separate from the heating member, and that forms a nip portion between the pressure member and the heating member by coming into contact with the heating member, the nip portion being a portion through which the recording medium passes;

a first elastic member that is arranged at an inner side of the heating member, and that is elastically deformed at the nip portion by a pressing force from the pressure member;

a second elastic member being arranged between an outer circumferential surface of the first elastic member and an inner circumferential surface of the heating member while being fixed to both of the first elastic member and the heating member, and having a larger elastic deformation ratio at the nip portion than the first elastic member, and a support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member, wherein the heating device comprises the second elastic member, and the second elastic member has a lower thermal conductivity than the first elastic member.

11. The image forming apparatus according to claim 10, wherein the heating unit further comprises a contacting/separating unit that causes the pressure member to come into contact with and to separate from the heating member, and the contacting/separating unit of the heating unit sets the pressure member at a position where the pressure member is separated from the heating member until the heating member is heated to a predetermined temperature, and the contacting/separating unit of the heating unit sets the pressure member at a position where the pressure member is in contact with the heating member when the heating member is heated to the predetermined temperature.

12. The image forming apparatus according to claim 10, wherein the heating unit further comprises a contacting/separating unit that causes the pressure member to come into contact with and to separate from the heating member, and the contacting/separating unit of the heating unit sets the pressure member at a position where the pressure member is separated from the heating member until the heating member is heated to a predetermined temperature, and the contacting/separating unit of the heating unit sets the pressure member at a position where the pressure member presses the first elastic member via the heating member when the heating member is heated to the predetermined temperature.

13. A heating device comprising:

a heating member that includes a heat generation layer generating heat through electromagnetic induction, and that heats a recording medium by the heat generation layer heated through electromagnetic induction;

a pressure member that is configured to come into contact with and to separate from the heating member, and that forms a nip portion between the pressure member and the heating member by coming into contact with the heating member, the nip portion being a portion through which the recording medium passes;

a first elastic member that is arranged at an inner side of the heating member, and that is elastically deformed at the nip portion by a pressing force from the pressure member;

a second elastic member being arranged between an outer circumferential surface of the first elastic member and an inner circumferential surface of the heating member while being fixed to both of the first elastic member and the heating member, and having a larger elastic deformation ratio at the nip portion than the first elastic member, and a support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member wherein the heating device comprises the second elastic member, and the second elastic member is arranged on each of both sides of the heating member in a width direction of the heating member with respect to a center of the heating member in the width direction, and wherein the first elastic member has a recessed portion formed in a region where the second elastic member is arranged.

14. A heating device comprising:

a heating member that includes a heat generation layer generating heat through electromagnetic induction, and that heats a recording medium by the heat generation layer heated through electromagnetic induction;

a pressure member that is configured to come into contact with and to separate from the heating member, and that forms a nip portion between the pressure member and the heating member by coming into contact with the heating member, the nip portion being a portion through which the recording medium passes;

a first elastic member that is arranged at an inner side of the heating member, and that is elastically deformed at the nip portion by a pressing force from the pressure member;

a second elastic member being arranged between an outer circumferential surface of the first elastic member and an inner circumferential surface of the heating member while being fixed to both of the first elastic member and the heating member, and having a larger elastic deformation ratio at the nip portion than the first elastic member, and a support member supporting the heating member and the first elastic member so as to form a gap between the outer circumferential surface of the first elastic member and the inner circumferential surface of the heating member, and rotating both of the heating member and the first elastic member when a rotational drive force is transmitted to the support member, wherein the heating device comprises the support member, and the support member is arranged at each of both edge portions of the heating member, and is configured so that a portion of the support member supporting the heating member deforms in accordance with deformation of the heating member when the pressure member is set at the position where the pressure member presses the first elastic member via the heating member.

* * * * *